US008906224B2

(12) United States Patent
Prentice et al.

(10) Patent No.: US 8,906,224 B2
(45) Date of Patent: Dec. 9, 2014

(54) SWEET OR SOUR SERVICE CATALYTIC DEWAXING IN BLOCK MODE CONFIGURATION

(75) Inventors: Krista Marie Prentice, Bethlehem, PA (US); Michel Daage, Hellertown, PA (US); Gary Paul Schleicher, Milford, NJ (US); Christine Nicole Elia, Bridgewater, NJ (US); Stephen J. McCarthy, Center Valley, PA (US); Wenyih F. Lai, Bridgewater, NJ (US); Shifang L. Luo, Kingwood, TX (US); Robert Andrew Migliorini, North Haven, CT (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 833 days.

(21) Appl. No.: 12/975,538

(22) Filed: Dec. 22, 2010

(65) Prior Publication Data

US 2011/0174684 A1 Jul. 21, 2011

Related U.S. Application Data

(60) Provisional application No. 61/284,740, filed on Dec. 23, 2009.

(51) Int. Cl.

| | |
|---|---|
| ***C10G 69/02*** | (2006.01) |
| ***C10G 65/04*** | (2006.01) |
| ***C10G 45/64*** | (2006.01) |

(52) U.S. Cl.

CPC ..... *C10G 65/043* (2013.01); *C10G 45/64* (2013.01); *C10G 2300/4025* (2013.01); *C10G 2300/1062* (2013.01); *C10G 2300/202* (2013.01); *C10G 2300/207* (2013.01); *C10G 2300/304* (2013.01); *C10G 2300/4006* (2013.01); *C10G 2400/10* (2013.01)

USPC ..... 208/97; 208/14; 208/89

(58) Field of Classification Search

CPC ..... C10G 67/00; C10G 45/64; C10G 73/02; C10G 2400/10; C10G 73/42; C10G 73/44

USPC ..... 208/97, 18, 89

See application file for complete search history.

(56) References Cited

U.S. PATENT DOCUMENTS

| | | | | |
|---|---|---|---|---|
| 3,900,427 | A * | 8/1975 | Riley et al. | 502/255 |
| 4,397,827 | A * | 8/1983 | Chu | 423/705 |
| 4,851,109 | A | 7/1989 | Chen et al. | |
| 5,951,848 | A | 9/1999 | Baker, Jr. et al. | |
| 5,993,644 | A | 11/1999 | Xiao et al. | |

(Continued)

OTHER PUBLICATIONS

J. H. Sinfelt, Highly Dispersed Catalytic Materials, Ann. Rev. Mat. Sci. 2, 641 (1972).*

(Continued)

*Primary Examiner* — Prem C Singh
*Assistant Examiner* — Brandi M Doyle
(74) *Attorney, Agent, or Firm* — Robert A. Migliorini

(57) ABSTRACT

Sweet and sour lubricant feeds are block and continuous processed to produce lubricant basestocks. Total liquid product yields at a desired pour point are maintained for catalytic dewaxing of both sweet and sour conditions. The desired pour point is achieved for both the sweet and sour feeds by varying the catalytic dewaxing reaction temperature as a function of sulfur content entering the reactor.

34 Claims, 9 Drawing Sheets

(56) References Cited

U.S. PATENT DOCUMENTS

| | | | | |
|---|---|---|---|---|
| 6,261,441 | B1 | 7/2001 | Gentry et al. | |
| 6,287,454 | B1 | 9/2001 | Forbus, Jr. et al. | |
| 7,077,948 | B1 | 7/2006 | Barre et al. | |
| 2003/0102254 | A1* | 6/2003 | Eijsbouts et al. | 208/216 R |
| 2003/0150776 | A1* | 8/2003 | Johnson et al. | 208/80 |
| 2003/0168379 | A1 | 9/2003 | Degnan et al. | |
| 2004/0065587 | A1* | 4/2004 | Collin et al. | 208/89 |
| 2004/0108250 | A1* | 6/2004 | Murphy et al. | 208/89 |
| 2004/0232045 | A1 | 11/2004 | Simmons et al. | |
| 2006/0252632 | A1* | 11/2006 | Cody et al. | 502/64 |
| 2009/0005627 | A1 | 1/2009 | Sinclair et al. | |
| 2009/0186754 | A1 | 7/2009 | Elia et al. | |
| 2010/0187156 | A1 | 7/2010 | Prentice et al. | |

OTHER PUBLICATIONS

Johnson, Marvin F. L., "Estimation of the Zeolite Content of a Catalyst from Nitrogen Adsorption Isotherms", Journal of Catalysis, 52, 425-431 (1978).

* cited by examiner

SWEET OR SOUR SERVICE CATALYTIC DEWAXING IN BLOCK MODE CONFIGURATION

CROSS-REFERENCE TO RELATED APPLICATIONS

This is a non-provisional application that claims priority to U.S. Provisional Patent Application No. 61/284,740 filed on Dec. 23, 2009, herein incorporated by reference in its entirety.

FIELD

This disclosure provides a method for block mode and continuous mode catalytic dewaxing of feeds having varying sulfur contents for lubricant basestocks.

BACKGROUND

Catalytic dewaxing can be used to improve the cold flow properties of a hydrocarbon feed. This can allow for production of lubricant basestocks with improved properties. Unfortunately, many conventional catalytic dewaxing methods are sensitive to the sulfur content of a feedstock. Using such conventional dewaxing methods, the sulfur and/or nitrogen content of a feedstock is reduced to low levels, such as less than 100 wppm of sulfur, prior to catalytic dewaxing. Conventionally, the reduction of sulfur and/or nitrogen levels is required in order to maintain catalyst activity and achieve desired yields of lube basestock.

U.S. Pat. No. 5,951,848 provides a method for treating a hydrocarbon feedstock by first exposing the feedstock to a high activity hydrotreating catalyst to reduce the levels of, for example, nitrogen, sulfur, and aromatics. The hydrotreated feed is then dewaxed using a dewaxing catalyst, such as ZSM-23, ZSM-35, or ZSM-48.

U.S. Pat. No. 7,077,948 provides a method for catalytic dewaxing. The method includes treating a feed having at least 500 ppm sulfur with a dewaxing catalyst that includes an aluminosilicate zeolite. The dewaxing catalyst also includes a binder that is essentially free of aluminum. The method discloses that catalytic dewaxing occurs prior to hydrotreating.

U.S. Published Patent Application 2009/0005627 describes a method for integrated hydroprocessing of feeds having varying wax contents. The method includes operating a reaction system in a blocked mode, where feeds having differing wax contents can be processed in a single reaction train by varying the reaction temperature.

There is a need for improved methods of dewaxing lubricant feedstocks having varying levels of sulfur contaminants to form lubricant basestocks without the need for separating such sulfur contaminants prior to the catalytic dewaxing step of the process.

SUMMARY

In an embodiment, a method is provided for producing a lube basestock. The method includes providing a process train including a first catalyst that is a hydroprocessing catalyst, and a second catalyst that is a dewaxing catalyst, wherein the dewaxing catalyst includes at least one non-dealuminated, unidimensional 10-member ring pore zeolite and at least one Group VIII metal; processing a first feedstock in the process train at first hydroprocessing conditions and first catalytic dewaxing conditions to produce a lube basestock having a pour point less than −15° C. and a total liquid product 700°+F (371° C.) yield of at least 75 wt %, the first catalytic dewaxing conditions including a temperature of 400° C. or less, the first feedstock having a first sulfur content when exposed to the dewaxing catalyst of 1000 wppm or less on a total sulfur basis; processing a second feedstock in the same process train at second hydroprocessing conditions and second catalytic dewaxing conditions, the second feedstock having a sulfur content when exposed to the dewaxing catalyst of greater than 1000 wppm on a total sulfur basis, to produce a second lube basestock having a pour point less than −15° C. and a total liquid product yield of at least 75 wt %, wherein the second catalytic dewaxing conditions include a temperature of 400° C. or less with the second catalytic dewaxing temperature being from 20 to 50° C. greater than first catalytic dewaxing temperature, and wherein the processing of the first feedstock and the processing of the second feedstock are alternated in any sequence as a function of time.

In an alternative embodiment, a method is provided for producing a lube basestock, which includes providing a feedstock including sulfur in the range from 0.005 wt % to 5 wt. %, a process train including a first catalyst that is a hydroprocessing catalyst, and a second catalyst that is a dewaxing catalyst, a real-time hydroprocessed effluent sulfur monitor, and a process controller for controlling the temperature of the second catalyst as a function of the sulfur level in the hydroprocessed effluent, wherein the dewaxing catalyst includes at least one non-dealuminated, unidimensional 10-member ring pore zeolite and at least one Group VIII metal; monitoring the sulfur level of the hydroprocessed effluent using the sulfur monitor followed by controlling the dewaxing catalyst temperature as a function of the sulfur level of the hydroprocessed effluent using the process controller; processing the feedstock in the process train at effective hydroprocessing conditions and effective catalytic dewaxing conditions sufficient to produce a lube basestock having a pour point less than −15° C. and a total liquid product 700°+F (371° C.) yield of at least 75 wt %; and wherein the process controller increases the temperature of the dewaxing catalyst with increasing sulfur level in the hydroprocessed effluent up to a maximum of 400° C.

DETAILED DESCRIPTION

Figure 1:
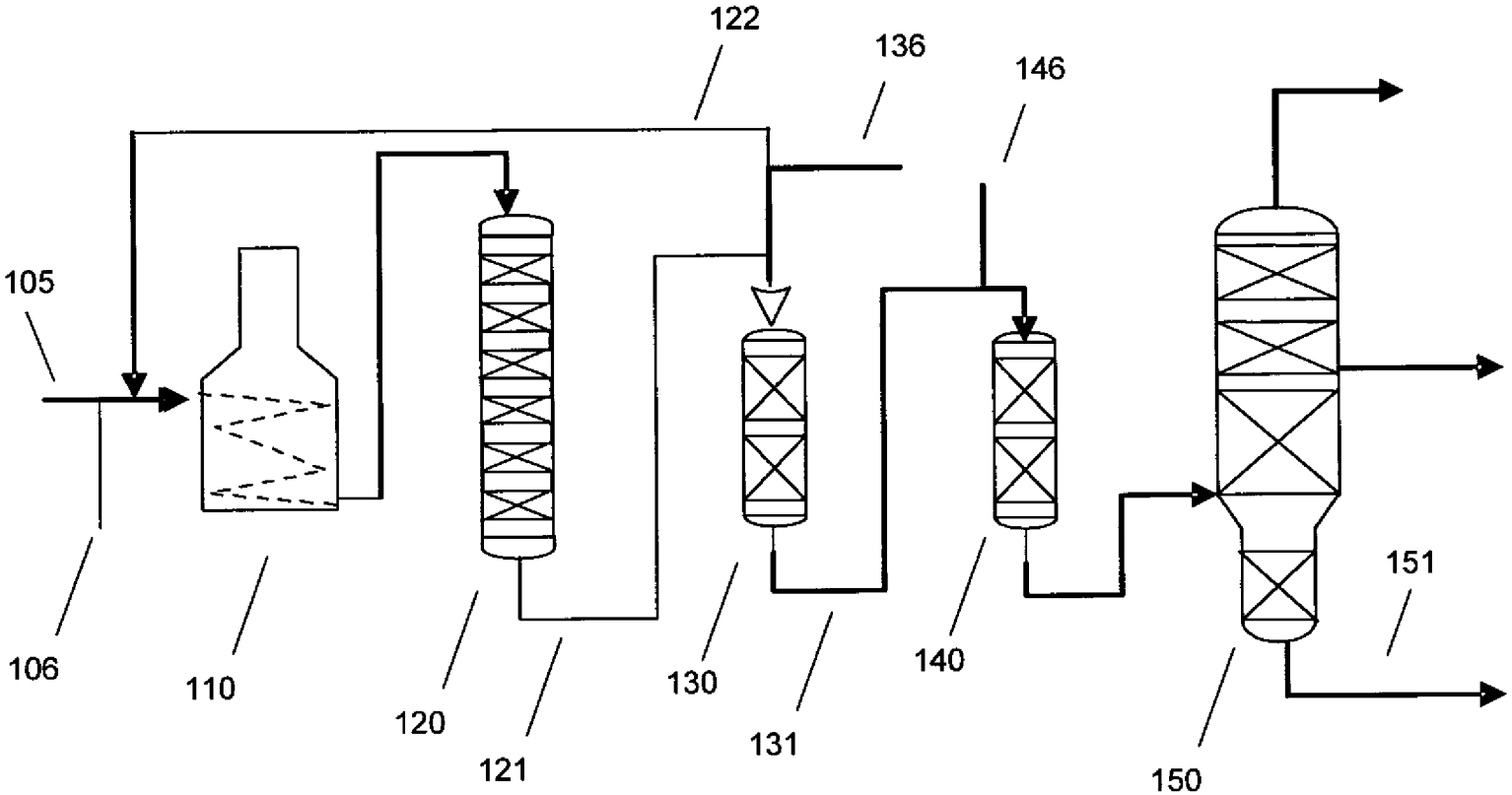
FIG. 1 schematically shows a reaction system for performing a process according to an embodiment of the disclosure without interstage separation between hydroprocessing and dewaxing.

All numerical values within the detailed description and the claims herein are modified by "about" or "approximately" the indicated value, and take into account experimental error and variations that would be expected by a person having ordinary skill in the art.

Overview:

In various embodiments, methods are provided for block operation of a lubricant basestock catalytic dewaxing reaction system in order to allow for repeated processing of both sweet and sour hydrocarbon feeds in any sequence. The reaction system can achieve desirable yields of lube basestock from various types of sweet and sour hydrocarbon feeds based on variations in the process temperature. The processing of both sweet and sour feeds is enabled, in part, by selection of a suitable catalyst.

In other embodiments, methods are provided for continuous operation to of a lubricant basestock catalytic dewaxing reaction system in order for continuous processing of hydrocarbon feeds with a broad range of sulfur contaminant levels by on-line monitoring of sulfur level and closed loop control back to dewaxing temperature.

In some embodiments, the ability to process feeds under both sweet and sour conditions in the same reaction system can be used to provide flexibility in selecting a hydrocarbon feed.

In still other embodiments, the ability to process both sweet and sour feeds can be used to respond to process "upset" events. In such an embodiment, a reaction system can be set up that includes a hydrotreatment stage and optionally a separation step prior to catalytic dewaxing. If the separation process fails to work properly for some reason, the amount of sulfur and/or nitrogen delivered to the dewaxing step can increase. Conventionally, such a situation would likely require the reaction system to be shut down until the difficulty in the hydrotreatment stage and/or separation process is corrected. By contrast, the inventive method described below can allow the reaction system to keep operating at an increased temperature while still maintaining desired levels of quality and yield of the product lube basestock.

Alternatively, the methods described below can be used to maintain desired yield and lube basestock quality in a situation where the scrubbers for a hydrogen recycle loop do not function properly, leading to elevated levels of $H_2S$ or $NH_3$ in the hydrogen feed. Conventionally, an increase in the sulfur and/or nitrogen level in the hydrogen feed could require a halt in processing until hydrogen purity is restored. However, the methods described below can allow for production of lube basestocks of desired yield and quality. In yet another embodiment, a portion of the hydrogen gas stream produced from a separation process can be recycled to a processing stage without purification of the gas. This recycled hydrogen stream can be used to supplement a fresh hydrogen feed.

Alternatively, the methods described below can be used to provide for real time closed-loop temperature control of the catalytic dewaxing step as a function of the sulfur level of the hydroprocessed feedstock fed to the dewaxer. As the sulfur level of the hydroprocessed feedstock is increased as measured by on-line monitoring methods, the temperature of the dewaxer may be increased to still provide for effective dewaxing, Feedstock:

In an embodiment, feedstocks suitable for production of Group II, Group II+, and Group III basestocks can be upgraded using the methods described below. A preferred feedstock can be a feedstock for forming a lube oil basestock. Such feedstocks can be wax-containing feeds that boil in the lubricating oil range, typically having a 10% distillation point greater than 650° F. (343° C.), measured by ASTM D 86 or ASTM D2887, and are derived from mineral or synthetic sources. The feeds may be derived from a number of sources such as oils derived from solvent refining processes such as raffinates, partially solvent dewaxed oils, deasphalted oils, distillates, vacuum gas oils, coker gas oils, slack waxes, foots oils and the like, and Fischer-Tropsch waxes. Preferred feeds can be slack waxes and Fischer-Tropsch waxes. Slack waxes are typically derived from hydrocarbon feeds by solvent or propane dewaxing. Slack waxes contain some residual oil and are typically deoiled. Foots oils are derived from deoiled slack waxes. Fischer-Tropsch waxes can be prepared by the Fischer-Tropsch synthetic process.

Feedstocks can have high contents of nitrogen- and sulfur-contaminants. In an embodiment, the combined total sulfur content of a liquid feedstream and hydrogen containing gas can be at least about 0.005 wt % sulfur, or at least about 0.1 wt %, or at least about 0.5 wt %, or at least about 1 wt %, or at least about 2 wt %, or at least about 5 wt %. Sulfur content can be measured by standard ASTM methods D5453.

Hydroprocessing Catalyst:

As used herein, the term "hydroprocessing" refers generally to processes using hydrogen and a suitable catalyst as a component of the reaction system, and includes, but is not limited to the following hydrocarbon based processes: hydroconversion, hydrocracking, hydrotreatment, hydrofinishing, aromatic saturation and dealkylation.

In an embodiment, one or more of the hydroprocessing catalysts can be catalysts suitable for hydrotreatment, hydrocracking, hydrofinishing, dealkylation, and/or aromatic saturation of a feedstock. In such an embodiment, the catalyst can be composed of one or more Group VIII and/or Group VI metals on a support. Suitable metal oxide supports include low acidic oxides such as silica, alumina, silica-aluminas or titania. The supported metals can include Co, Ni, Fe, Mo, W, Pt, Pd, Rh, Ir, or a combination thereof. Preferably, the supported metal is Pt, Pd, or a combination thereof. The amount of metals, either individually or in mixtures, ranges from about 0.1 to 35 wt %, based on the catalyst. In an embodiment, the amount of metals, either individually or in mixtures, is at least 0.1 wt %, or at least 0.25 wt %, or at least 0.5 wt %, or at least 0.6 wt %, or at least 0.75 wt %, or at least 1 wt %. In another embodiment, the amount of metals, either individually or in mixtures, is 35 wt % or less, or 20 wt % or less, or 15 wt % or less, or 10 wt % or less, or 5 wt % or less. In preferred embodiments wherein the supported metal is a noble metal, the amount of metals is typically less than 1 wt %. In such embodiments, the amount of metals can be 0.9 wt % or less, or 0.75 wt % or less, or 0.6 wt % or less. The amounts of metals may be measured by methods specified by ASTM for individual metals including atomic absorption spectroscopy or inductively coupled plasma-atomic emission spectrometry.

In a preferred embodiment, a hydrotreating, hydrofinishing, or aromatic saturation catalyst can be a Group VIII and/or Group VI metal supported on a bound support from the M41S family, such as bound MCM-41. The M41S family of catalysts are mesoporous materials having high silica contents whose preparation is further described in J. Amer. Chem. Soc., 1992, 114, 10834. Examples include MCM-41, MCM-48 and MCM-50. Mesoporous refers to catalysts having pore sizes from 15 to 100 Angstroms. A preferred member of this class is MCM-41, whose preparation is described in U.S. Pat. No. 5,098,684. MCM-41 is an inorganic, porous, non-layered phase having a hexagonal arrangement of uniformly-sized pores. The physical structure of MCM-41 is like a bundle of straws wherein the opening of the straws (the cell diameter of the pores) ranges from 15 to 100 Angstroms. MCM-48 has a cubic symmetry and is described for example is U.S. Pat. No. 5,198,203 whereas MCM-50 has a lamellar structure. MCM-41 can be made with different size pore openings in the mesoporous range. Suitable binders for the MCM-41 can include Al, Si, or any other binder or combination of binders that provides a high productivity and/or low density catalyst. One example of a suitable aromatic saturation catalyst is Pt on alumina bound mesoporous MCM-41. Such a catalyst can be impregnated with a hydrogenation metal such as Pt, Pd, another Group VIII metal, a Group VI metal, or a mixture of metals thereof. In an embodiment, the amount of Group VIII metal is at least 0.1 wt. % per weight of catalyst. Preferably, the amount of Group VIII metal is at least 0.5 wt %, or at least 0.6 wt %. In such embodiments, the amount of metals can be 1.0 wt % or less, or 0.9 wt % or less, or 0.75 wt % or less, or 0.6 wt % or less. In still other embodiments, the amount of metals, either individually or in mixtures, is at least 0.1 wt %, or at least 0.25 wt %, or at least 0.5 wt %, or at least 0.6 wt %, or at least 0.75 wt %, or at least 1 wt %. In yet other embodiments, the amount of metals, either individually or in mixtures, is 35 wt % or less, or 20 wt % or less, or 15 wt % or less, or 10 wt % or less, or 5 wt % or less.

Dewaxing Catalyst:

In various embodiments, the dewaxing catalyst used according to the disclosure is tolerant of the presence of sulfur and/or nitrogen during processing. Suitable catalysts can include ZSM-48 or ZSM-23. Other suitable catalysts can include 1-dimensional 10-member ring zeolites. In still other embodiments suitable catalysts can include EU-2, EU-11, or ZBM-30. It is also noted that ZSM-23 with a silica to alumina ratio between about 20 to 1 and about 40 to 1 is sometimes referred to as SSZ-32.

Preferably, the dewaxing catalysts used in processes according to the disclosure are catalysts with a low ratio of silica to alumina. For example, for ZSM-48, the ratio of silica to alumina in the zeolite can be less than 200:1, or less than 110:1, or less than 100:1, or less than 90:1, or less than 80:1. In preferred embodiments, the ratio of silica to alumina can be from 30:1 to 200:1, 60:1 to 110:1, or 70:1 to 100:1.

The dewaxing catalysts useful in processes according to the disclosure can be self-bound or include a binder. In some embodiments, the dewaxing catalysts used in process according to the disclosure are formulated using a low surface area binder, a low surface area binder represents a binder with a surface area of 100 $m^2/g$ or less, or 80 $m^2/g$ or less, or 70 $m^2/g$ or less, or 60 $m^2/g$ or less, or 50 $m^2/g$ or less, or 40 $m^2/g$ or less, or 30 $m^2/g$ or less.

Alternatively, the binder and the zeolite particle size are selected to provide a catalyst with a desired ratio of micropore surface area to total surface area. In dewaxing catalysts used according to the disclosure, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%, or equal to or greater than 30%, or equal to or greater than 35%, or equal to or greater than 40%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

Dewaxing Catalyst Synthesis:

In one form the of the present disclosure, the catalytic dewaxing catalyst includes from 0.1 wt % to 2.7 wt % framework alumina, 0.1 wt % to 5 wt % Pt, 200:1 to 30:1 $SiO_2$:$Al_2O_3$ ratio and at least one low surface area, refractory metal oxide binder with a surface area of 100 $m^2/g$ or less.

One example of a molecular sieve suitable for use in the claimed disclosure is ZSM-48 with a $SiO_2$:$Al_2O_3$ ratio of less than 110, preferably from about 70 to about 110. In the embodiments below, ZSM-48 crystals will be described variously in terms of "as-synthesized" crystals that still contain the (200:1 or less $SiO_2$:$Al_2O_3$ ratio) organic template; calcined crystals, such as Na-form ZSM-48 crystals; or calcined and ion-exchanged crystals, such as H-form ZSM-48 crystals.

The ZSM-48 crystals after removal of the structural directing agent have a particular morphology and a molar composition according to the general formula:

$$(n)SiO_2:Al_2O_3$$

where n is from 70 to 110, preferably 80 to 100, more preferably 85 to 95. In another embodiment, n is at least 70, or at least 80, or at least 85. In yet another embodiment, n is 110 or less, or 100 or less, or 95 or less. In still other embodiments, Si may be replaced by Ge and Al may be replaced by Ga, B, Fe, Ti, V, and Zr.

The as-synthesized form of ZSM-48 crystals is prepared from a mixture having silica, alumina, base and hexamethonium salt directing agent. In an embodiment, the molar ratio of structural directing agent:silica in the mixture is less than 0.05, or less than 0.025, or less than 0.022. In another embodiment, the molar ratio of structural directing agent:silica in the mixture is at least 0.01, or at least 0.015, or at least 0.016. In still another embodiment, the molar ratio of structural directing agent:silica in the mixture is from 0.015 to 0.025, preferably 0.016 to 0.022. In an embodiment, the as-synthesized form of ZSM-48 crystals has a silica:alumina molar ratio of 70 to 110. In still another embodiment, the as-synthesized form of ZSM-48 crystals has a silica:alumina molar ratio of at least 70, or at least 80, or at least 85. In yet another embodiment, the as-synthesized form of ZSM-48 crystals has a silica:alumina molar ratio of 110 or less, or 100 or less, or 95 or less. For any given preparation of the as-synthesized form of ZSM-48 crystals, the molar composition will contain silica, alumina and directing agent. It should be noted that the as-synthesized form of ZSM-48 crystals may have molar ratios slightly different from the molar ratios of reactants of the reaction mixture used to prepare the as-synthesized form. This result may occur due to incomplete incorporation of 100% of the reactants of the reaction mixture into the crystals formed (from the reaction mixture).

The ZSM-48 composition is prepared from an aqueous reaction mixture comprising silica or silicate salt, alumina or soluble aluminate salt, base and directing agent. To achieve the desired crystal morphology, the reactants in reaction mixture have the following molar ratios:

$SiO_2:Al_2O_3$ (preferred)=70 to 110

$H_2O:SiO_2$=1 to 500

OH—:$SiO_2$=0.1 to 0.3

OH—:$SiO_2$ (preferred)=0.14 to 0.18 template:$SiO_2$=0.01–0.05 template:$SiO_2$ (preferred)=0.015 to 0.025

In the above ratios, two ranges are provided for both the base:silica ratio and the structure directing agent:silica ratio. The broader ranges for these ratios include mixtures that result in the formation of ZSM-48 crystals with some quantity of Kenyaite and/or needle-like morphology. For situations where Kenyaite and/or needle-like morphology is not desired, the preferred ranges should be used, as is further illustrated below in the Examples.

The silica source is preferably precipitated silica and is commercially available from Degussa. Other silica sources include powdered silica including precipitated silica such as Zeosil® and silica gels, silicic acid colloidal silica such as Ludox® or dissolved silica. In the presence of a base, these other silica sources may form silicates. The alumina may be in the form of a soluble salt, preferably the sodium salt and is commercially available from US Aluminate. Other suitable aluminum sources include other aluminum salts such as the chloride, aluminum alcoholates or hydrated alumina such as gamma alumina, pseudobohemite and colloidal alumina. The base used to dissolve the metal oxide can be any alkali metal hydroxide, preferably sodium or potassium hydroxide, ammonium hydroxide, diquaternary hydroxide and the like. The directing agent is a hexamethonium salt such as hexamethonium dichloride or hexamethonium hydroxide. The anion (other than chloride) could be other anions such as hydroxide, nitrate, sulfate, other halide and the like. Hexamethonium dichloride is N,N,N,N',N',N'-hexamethyl-1,6-hexanediammonium dichloride.

In an embodiment, the crystals obtained from the synthesis according to the disclosure have a morphology that is free of fibrous morphology. Fibrous morphology is not desired, as this crystal morphology inhibits the catalytic dewaxing activity of ZSM-48. In another embodiment, the crystals obtained from the synthesis according to the disclosure have a morphology that contains a low percentage of needle-like morphology. The amount of needle-like morphology present in the ZSM-48 crystals can be 10% or less, or 5% or less, or 1% or less. In an alternative embodiment, the ZSM-48 crystals can be free of needle-like morphology. Low amounts of needle-like crystals are preferred for some applications as needle-like crystals are believed to reduce the activity of ZSM-48 for some types of reactions. To obtain a desired morphology in high purity, the ratios of silica:alumina, base:silica and directing agent:silica in the reaction mixture according to embodiments of the disclosure should be employed. Additionally, if a composition free of Kenyaite and/or free of needle-like morphology is desired, the preferred ranges should be used.

The as-synthesized ZSM-48 crystals should be at least partially dried prior to use or further treatment. Drying may be accomplished by heating at temperatures of from 100 to 400° C., preferably from 100 to 250° C. Pressures may be atmospheric or subatmospheric. If drying is performed under partial vacuum conditions, the temperatures may be lower than those at atmospheric pressures.

Catalysts are typically bound with a binder or matrix material prior to use. Binders are resistant to temperatures of the use desired and are attrition resistant. Binders may be catalytically active or inactive and include other zeolites, other inorganic materials such as clays and metal oxides such as alumina, silica, titania, zirconia, and silica-alumina. Clays may be kaolin, bentonite and montmorillonite and are commercially available. They may be blended with other materials such as silicates. Other porous matrix materials in addition to silica-aluminas include other binary materials such as silica-magnesia, silica-thoria, silica-zirconia, silica-beryllia and silica-titania as well as ternary materials such as silica-alumina-magnesia, silica-alumina-thoria and silica-alumina-zirconia. The matrix can be in the form of a co-gel. The bound ZSM-48 framework alumina will range from 0.1 wt % to 2.7 wt % framework alumina.

ZSM-48 crystals as part of a catalyst may also be used with a metal hydrogenation component. Metal hydrogenation components may be from Groups 6-12 of the Periodic Table based on the IUPAC system having Groups 1-18, preferably Groups 6 and 8-10. Group VIII metals are particularly advantageous with the dewaxing catalysts of the instant disclosure. Examples of such metals include Ni, Mo, Co, W, Mn, Cu, Zn, Ru, Pt or Pd, preferably Pt or Pd. Mixtures of hydrogenation metals may also be used such as Co/Mo, Ni/Mo, Ni/W and Pt/Pd, preferably Pt/Pd. The amount of hydrogenation metal or metals may range from 0.1 to 5 wt. %, based on catalyst. In an embodiment, the amount of metal or metals is at least 0.1 wt %, or at least 0.25 wt %, or at least 0.5 wt %, or at least 0.6 wt %, or at least 0.75 wt %, or at least 0.9 wt %. In another embodiment, the amount of metal or metals is 5 wt % or less, or 4 wt % or less, or 3 wt % or less, or 2 wt % or less, or 1 wt % or less. Methods of loading metal onto ZSM-48 catalyst are well known and include, for example, impregnation of ZSM-48 catalyst with a metal salt of the hydrogenation component and heating. The ZSM-48 catalyst containing hydrogenation metal may also be sulfided prior to use.

High purity ZSM-48 crystals made according to the above embodiments have a relatively low silica:alumina ratio. This lower silica:alumina ratio means that the present catalysts are more acidic. In spite of this increased acidity, they have superior activity and selectivity as well as excellent yields. They also have environmental benefits from the standpoint of health effects from crystal form and the small crystal size is also beneficial to catalyst activity.

For catalysts according to the disclosure that incorporate ZSM-23, any suitable method for producing ZSM-23 with a low $SiO_2:Al_2O_3$ ratio may be used. U.S. Pat. No. 5,332,566 provides an example of a synthesis method suitable for producing ZSM-23 with a low ratio of $SiO_2:Al_2O_3$. For example, a directing agent suitable for preparing ZSM-23 can be formed by methylating iminobispropylamine with an excess of iodomethane. The methylation is achieved by adding the iodomethane dropwise to iminobispropylamine which is solvated in absolute ethanol. The mixture is heated to a reflux temperature of 77° C. for 18 hours. The resulting solid product is filtered and washed with absolute ethanol.

The directing agent produced by the above method can then be mixed with colloidal silica sol (30% $SiO_2$), a source of alumina, a source of alkali cations (such as Na or K), and deionized water to form a hydrogel. The alumina source can be any convenient source, such as alumina sulfate or sodium aluminate. The solution is then heated to a crystallization temperature, such as 170° C., and the resulting ZSM-23 crystals are dried. The ZSM-23 crystals can then be combined with a low surface area binder to form a catalyst according to the disclosure.

Hydroprocessing Conditions:

In an embodiment, a feedstock may be hydroprocessed prior to catalytic dewaxing. Non-limiting exemplary hydroprocessing methods include hydroconversion, hydrocracking, hydrotreatment, hydrofinishing, aromatic saturation and dealkylation.

The hydroprocessing conditions can be conditions effective for performing a typical hydrotreatment on a lubricating oil feed, such as conditions for a raffinate hydroconversion stage or conditions for a dealkylation stage. Effective hydroprocessing conditions include temperatures of up to about 426° C., preferably from about 150° C. to about 400° C., more preferably about 200° C. to about 380° C., a hydrogen partial pressure of from about 1480 kPa to about 20786 kPa (200 to 3000 psig), preferably about 2859 kPa to about 13891 kPa (400 to 2000 psig), a space velocity of from about 0.1 $hr^{-1}$ to about 10 $hr^{-1}$, preferably about 0.1 $hr^{-1}$ to about 5 $hr^{-1}$, and a hydrogen to feed ratio of from about 89 $m^3/m^3$ to about 1780 $m^3/m^3$ (500 to 10000 scf/B), preferably about 178 $m^3/m^3$ to about 890 $m^3/m^3$.

In embodiments involving a raffinate hydroconversion stage, the effective hydroconversion conditions can include a temperature of from about 320° C. to about 420° C., preferably about 340° C. to about 400° C., a hydrogen partial pressure of about 800 psig to about 2500 psig (5.6 to 17.3 MPa), preferably about 800 psig to about 2000 psig (5.6 to 13.9 MPa), a space velocity of from about 0.2 $hr^{-1}$ to about 5.0 $hr^{-1}$ LHSV, preferably about 0.3 $hr^{-1}$ to about 3.01 $hr^{-1}$ LHSV and a hydrogen to feed ratio of from about 500 scf/B to about 5000 scf/B (89 to 890 $m^3/m^3$), preferably about 2000 scf/B to about 4000 scf/B (356 to 712 $m^3/m^3$).

In an embodiment, the hydroprocessing step can be performed in the same reactor as the hydrodewaxing, with the same treat gas and at the same temperature. In another embodiment, stripping does not occur between the hydroprocessing and hydrodewaxing steps. In still another embodiment, heat exchange does not occur between the hydroprocessing and hydrodewaxing steps, although heat may be removed from the reactor by a liquid or gas quench.

Alternatively, the feedstock may be hydrofinished or undergo aromatic saturation either before or after dewaxing. It is desirable to hydrofinish or saturate aromatics in the product resulting from dewaxing in order to adjust product qualities to desired specifications. Hydrofinishing and aromatic saturation are forms of mild hydrotreating/hydroprocessing directed to saturating any lube range olefins and residual aromatics as well as to removing any remaining heteroatoms and color bodies. The post dewaxing hydrofinishing or aromatic saturation is usually carried out in cascade with the dewaxing step. Generally the hydrofinishing or aromatic saturation will be carried out at under effective conditions, which include temperatures from about 150° C. to about 350° C., preferably about 180° C. to about 300° C. Total pressures are typically from about 2859 kPa to about 20786 kPa (400 to 3000 psig). Liquid hourly space velocity (LHSV) is typically from about 0.1 $hr^{-1}$ to about 6 $hr^{-1}$, preferably about 0.5 $hr^{-1}$ to about 4 $hr^{-1}$ and hydrogen treat gas rates of from about 44.5 $m^3/m^3$ to about 1780 $m^3/m^3$ (250 to 10,000 scf/B).

In an embodiment, stripping does not occur between the hydrofinishing/aromatic saturation and hydrodewaxing steps. In a second embodiment, heat exchange does not occur between the hydrofinishing/aromatic saturation and hydrodewaxing steps, although heat may be removed from the reactor by a liquid or gas quench.

Dewaxing Conditions:

Effective dewaxing conditions in the catalytic dewaxing zone can include a temperature of from 200 to 450° C., preferably 270 to 400° C., a hydrogen partial pressure of from 1.5 to 34.6 mPa (200 to 5000 psi), preferably 4.8 to 20.8 mPa, a liquid hourly space velocity of from 0.1 to 10 v/v/hr, preferably 0.5 to 3.0, and a hydrogen circulation rate of from 35 to 1781.5 $m^3/m^3$ (200 to 10000 scf/B), preferably 178 to 890.6 $m^3/m^3$ (1000 to 5000 scf/B).

In various embodiments, a catalytic dewaxing stage may be referred to as a "sweet" or a "sour" stage. This characterization of the catalytic dewaxing stage can refer to the total combined sulfur in liquid and gaseous forms present during catalytic dewaxing. In the discussion provided herein, the sulfur content present in a catalytic dewaxing stage will be described in terms of the total concentration of sulfur in liquid and gaseous forms fed to the dewaxing stage in parts per million by weight (wppm) on the hydroprocessed feedstock basis. However, it is understood that some or all of the sulfur and/or nitrogen may be present as a gas phase contaminant. $H_2S$ is an example of a gas phase sulfur contaminant and $NH_3$ is an example of a gas phase nitrogen contaminant. It is noted that the gas phase contaminants may be present in a liquid effluent as dissolved gas phase components.

In an embodiment, a catalytic dewaxing stage can be characterized as a "sweet" or "clean" stage if the sulfur content is about 1000 wppm of sulfur or less, or about 700 wppm of sulfur or less, or about 500 wppm of sulfur or less, or about 300 wppm of sulfur or less, or about 100 wppm of sulfur or less. A "sour" or "dirty" stage can correspond to a sulfur content of greater than 1000 wppm of sulfur, or greater than 1500 wppm of sulfur, or greater than about 2000 wppm of sulfur, or greater than 5000 wppm of sulfur, or greater than 10,000 wppm of sulfur, or greater than 20,000 wppm of sulfur, or greater than 40,000 wppm of sulfur. As noted above, the concentration of sulfur can be in the form of organically bound sulfur or gas phase sulfur or a combination thereof.

The product from the hydroprocessing step can be directly cascaded into a catalytic dewaxing reaction zone. Unlike a conventional lubricant basestock process, no separation is required between the hydroprocessing and catalytic dewaxing stages. Elimination of the separation step has a variety of consequences. With regard to the separation itself, no additional equipment is needed. In some embodiments, the hydroprocessing stage and the catalytic dewaxing stage may be located in the same reactor. Alternatively, the hydroprocessing and catalytic dewaxing processes may take place in separate reactors. Eliminating the separation step saves the facilities investment costs and also avoids any need to repressurize the feed. Instead, the effluent from the hydroprocessing stage can be maintained at processing pressures as the effluent is delivered to the dewaxing stage.

Eliminating the separation step between hydroprocessing and catalytic dewaxing also means that any sulfur in the feed to the hydrotreating step will still be in the hydroprocessed effluent that is passed from the hydroprocessing step to the catalytic dewaxing step.

A portion of the organic sulfur in the feed to the hydroprocessing step will be converted to $H_2S$ during hydroprocessing. Similarly, organic nitrogen in the feed will be converted to ammonia. However, without a separation step, the $H_2S$ and $NH_3$ formed during hydroprocessing will travel with the effluent to the catalytic dewaxing stage. The lack of a separation step also means that any light gases ($C_1$-$C_4$) formed during hydroprocessing will still be present in the effluent. For "sour" stages, the total combined sulfur from the hydroprocessing process in both organic liquid form and gas phase (hydrogen sulfide) may be at least 1,000 ppm by weight, or at least 1,500 ppm by weight, or at least 2,000 ppm by weight, or at least 5,000 ppm by weight, or at least 10,000 ppm by weight, or at least 20,000 ppm by weight, or at least 40,000 ppm by weight. For "sweet" stages, the total combined sulfur from the hydrotreating process in both organic liquid form and gas phase (hydrogen sulfide) may be less than 1,000 ppm by weight, or 700 ppm by weight or less, or 500 ppm by weight or less, or 300 ppm by weight or less, or at 100 ppm by weight or less, or 50 ppm by weight or less. For the present disclosure, these sulfur levels are defined in terms of the total combined sulfur in liquid and gas forms fed to the dewaxing stage in parts per million (ppm) by weight on the hydrotreated feedstock basis.

Elimination of a separation step between hydroprocessing and catalytic dewaxing is enabled in part by the ability of a dewaxing catalyst to maintain catalytic activity in the presence of elevated levels of sulfur. Conventional dewaxing catalysts often require pre-treatment of a feedstream to reduce the sulfur content to less than a few hundred ppm in order to maintain lube yield production of greater than 80 wt %. By contrast, raffinates or hydrocracker bottoms or waxy feedstreams in combination with a hydrogen containing gas containing greater than 1000 ppm by weight total combined sulfur in liquid and gas forms based on the hydrotreated feedstream can be effectively processed using the inventive catalysts to create greater than 17 wt % increase in lube yield as compared to conventional dewaxing catalysts under similar sour conditions. In an embodiment, the total combined sulfur content in liquid and gas forms of the hydrogen containing gas and raffinates or hydrocracker bottoms or waxy feedstream can be greater than 0.1 wt %, or greater than 0.15 wt %, or greater than 0.2 wt %, or greater than 0.3 wt %, or greater than 0.4 wt %, or greater than 0.5 wt %, or greater than 1 wt %, or greater than 2 wt %, or greater than 4 wt %. In another embodiment, the total combined sulfur content in liquid and gas forms of the hydrogen containing gas and raffinates or hydrocracker bottoms or waxy feedstream can be less than 0.1 wt %, or less than 0.15 wt %, or less than 0.2 wt %, or less than 0.3 wt %, or less than 0.4 wt %, or less than 0.5 wt %, or less than 1 wt %, or less than 2 wt %, or less than 4 wt %. Sulfur content may be measured by standard ASTM methods D2622.

In an alternative embodiment, a simple flash high pressure separation step without stripping may be performed on the effluent from the hydroprocessing reactor without depressurizing the feed. In such an embodiment, the high pressure separation step allows for removal of any gas phase sulfur and/or nitrogen contaminants in the gaseous effluent. However, because the separation is conducted at a pressure comparable to the process pressure for the hydroprocessing or dewaxing step, the effluent will still contain substantial amounts of dissolved sulfur. For example, the amount of dissolved sulfur in the form of $H_2S$ can be 0 vppm, or at least 100 vppm, or at least 500 vppm, or at least 1000 vppm, or at least 2000 vppm.

Hydrogen treat gas circulation loops and make-up gas can be configured and controlled in any number of ways. In the direct cascade, treat gas enters the hydroprocessing reactor and can be once through or circulated by compressor from high pressure flash drums at the back end of the dewaxing section of the unit. In the simple flash configuration, treat gas can be supplied in parallel to both the hydroconversion and the dewaxing reactor in both once through or circulation mode. In circulation mode, make-up gas can be put into the unit anywhere in the high pressure circuit preferably into the dewaxing reactor zone. In circulation mode, the treat gas may be scrubbed with amine, or any other suitable solution, to remove $H_2S$ and $NH_3$. In another form, the treat gas can be recycled without cleaning or scrubbing. Alternately, the liquid effluent may be combined with any hydrogen containing gas, including but not limited to $H_2S$ containing gas. Make-up hydrogen can be added into the process unit anywhere in the high pressure section of the processing unit, preferably just prior to the catalytic dewaxing step.

Blocking of Feedstocks:

In still another embodiment, high productivity catalysts can be used for "blocking" of feedstocks. Blocking of feedstocks refers to using a process train for processing of two or more feedstocks with distinct properties, without having to modify the catalyst or equipment in the process train. As an example, a process train containing a hydroprocessing catalyst and a dewaxing catalyst can be used to hydroprocess a light neutral feed with a first sulfur content, such as less than about 1000 wppm of sulfur ("sweet" service). In blocked operation, the same process train can be used to process a different feed, such as a feed with a sulfur content of greater than about 1000 wppm ("sour" service) of sulfur or more, without modifying the operating conditions of the process train other than the dewaxing temperature. The flow rate of feedstock (LHSV), the catalyst, the hydrogen treat gas rate, the $H_2$ partial pressure at the inlet of the reactor, and the process train remain the same. The catalytic dewaxing temperature for processing the two different feeds can differ by about 50° C. or less, or by about 40° C. or less, or by about 30° C. or less, or by about 20° C. or less, or by about 10° C. or less or the same temperature profile can be used to process the two different feeds with the sour hydroprocessed feed generally requiring a higher dewaxing temperature than the sweet hydroprocessed feed. Generally, higher dewaxing temperatures are preferable when dewaxing a hydroprocessed feedstock with a higher level of sulfur and/or nitrogen. In one advantageous form, the catalytic dewaxing temperature may be 20 to 50° C. higher, or 25 to 45° C. higher, or 30 to 40° C. higher when catalytic dewaxing a sour hydroprocessed feed relative to a clean hydroprocessed feed. While the cost benefits of block operation have previously been recognized, previous attempts at block operation have not been successful in producing high quality basestock products.

In an embodiment where block processing includes catalytic dewaxing of a feed under sweet conditions and sour conditions, the temperature of the catalytic dewaxing process for both the sweet conditions and the sour conditions can be about 400° C. or less, about 375° C. or less, or about 365° C. or less, or about 355° C. or less. The temperature for catalytic dewaxing of the first hydroprocessed feedstock is preferably within about 50° C. of the temperature of the second hydroprocessed feedstock, or within about 40° C., or within about 20° C., or within about 10° C. Alternatively, the temperature profile for dewaxing of the two feedstocks can be about the same. Generally a higher catalytic dewaxing temperature is required with a feedstock stream to the dewaxing unit having a higher level of total combined sulfur content in liquid and gas forms in the feedstream.

The blocking of feedstocks between sour and sweet service to the process train may occur in any order or sequence as a function of time. That is the processing of a first sweet feedstock and the processing of a second sour feedstock may be alternated in any sequence as a function of time. The period of contact of a sweet or sour feedstock with the process train may range from as low as 1 day to 2 years, or 1 week to 18 months, or 1 month to 1 year, or 3 months to 6 months. This allows for an infinite number of time combinations in cycling between sweet mode and sour mode utilizing the block configuration described. The hydroprocessing catalyst life and the dewaxing catalyst life may range from 6 months to 10 years, or 1 year to 8 years, or 2 years to 7 years, or 3 years to 6 years or 4 years to 5 years.

Continuous Processing of Feedstocks:

In an alternative embodiment, the total combined sulfur content of the hydrotreated feedstock in liquid and gas forms may be monitored real time on-line using, for example, a sulfur monitor, and then fed back to control the temperature of the catalytic dewaxing reactor to compensate for higher or lower sulfur levels in the feedstock as a function of time. Hence, closed loop control between hydroprocessed feedstock sulfur level and the catalytic dewaxing reactor temperature provides for effective hydroprocessed feedstock dewaxing. In this closed loop temperature control mode of operation, an infinite number of hydroprocessed feedstocks of varying sulfur levels may be fed to the catalytic dewaxing reactor and still effectively dewaxed by real-time variation and control of the catalytic dewaxing temperature. Generally as the sulfur level of the hydroprocessed feedstock to the dewaxing reactor increase as measured by the on-line sulfur monitor, the closed loop controller will increase the temperature of the catalytic dewaxing reactor over the temperature ranges discussed above and still maintain lubricant basestock properties within acceptable ranges. The closed loop controller between the sulfur level of the hydroprocessed feedstock and the catalytic dewaxing temperature may utilize proportional control, integral control, derivative control and combinations thereof in order to optimize the control of dewaxing reactor temperature as a function of sulfur level in the hydroprocessed feedstock entering the dewaxing reactor.

In one form of this embodiment, a method for producing a lube basestock, includes: providing a feedstock including sulfur in the range from 0.005 wt % to 5 wt %, a process train including a first catalyst that is a hydroprocessing catalyst, and a second catalyst that is a dewaxing catalyst, a real-time hydroprocessed effluent sulfur monitor, and a process controller for controlling the temperature of the second catalyst as a function of the sulfur level in the hydroprocessed effluent, wherein the dewaxing catalyst includes at least one non-dealuminated, unidimensional 10-member ring pore zeolite and at least one Group VIII metal; monitoring the sulfur level of the hydroprocessed effluent using the sulfur monitor followed by controlling the dewaxing catalyst temperature as a function of the sulfur level of the hydroprocessed effluent using the process controller; processing the feedstock in the process train at effective hydroprocessing conditions and effective catalytic dewaxing conditions sufficient to produce a lube basestock having a pour point less than −15° C. and a total liquid product 700°+F (371° C.) yield of at least 75 wt %; and wherein the process controller increases the temperature of the dewaxing catalyst with increasing sulfur level in the hydroprocessed effluent up to a maximum of 400° C. In this continuous mode of operation, the catalytic dewaxing process temperature may be about 400° C. or less, or about 375° C. or less, or about 365° C. or less, or about 355° C. or less, or about 345° C. or less. In this continuous mode of operation, the process controller may adjust the dewaxing reactor temperature over a small range of temperatures (1° C. or less, 2° C. or less, 3° C. or less, 4° C. or less, 5° C. or less, 6° C. or less, 7° C. or less, 8° C. or less, 9° C. or less, 10° C. or less, 15° C. or less, 20° C. or less, 25° C. or less, 30° C. or less, 35° C. or less, 40° C. or less, 45° C. or less, 50° C. or less) as a function of increasing or decreasing sulfur level in the hydroprocessed effluent and as a function of the degree of change in sulfur level as a function of time. In one form, the process controller may vary the catalytic dewaxing temperature over a range of 1 to 50° C. higher, or 3 to 47° C. higher, or 5 to 45° C. higher, or 10 to 45° C. higher, or 15 to 45° C. higher, or 20 to 45° C. higher, or 25 to 45° C. higher, or 30 to 40° C. higher when the sulfur monitor detects a hydroprocessed effluent sulfur level that is higher as a function of time. The hydroprocessed effluent may be cascaded, with or without intermediate separation of sulfur containing gases, to the catalytic dewaxing reaction stage. The intermediate separation may include a high pressure separator and/or a stripper.

Product Characteristics:

In an embodiment, feedstocks can be hydroprocessed in the presence of various levels of sulfur while maintaining desired levels of yield and product quality for lube basestocks. The yield for a process for producing a lube basestock can be characterized in terms of the amount of basestock having a boiling point of at least 700° F. (371° C.) after processing. In an embodiment, the 700°+F yield for processing a "sweet" feed is similar for both the conventional and inventive dewaxing catalysts, however, for a "sour" feed, the 700°+F yield is at least 8 wt % higher, or at least 12 wt % higher, or at least 17 wt % higher for the inventive dewaxing catalyst as compared to the conventional dewaxing catalyst. The above yield can be achieved during processing that is effective for producing a lube basestock with a sufficiently low pour point. The pour point can be about −12° C. or less, or about −18° C. or less, or about −20° C. or less, or about −25° C. or less. The combination of pour point and yield can be achieved for processing of both "sweet" and "sour" feeds.

Sample Reaction Systems:

FIG. 1 schematically shows an example of a reaction system suitable for processing of a hydrocarbon feed according to the disclosure. In FIG. 1, a hydrocarbon feed 105 enters a pre-heating stage 110. As shown in FIG. 1, a stream of hydrogen 106 is added to feed 105 prior to entering the pre-heating stage 110. The pre-heated feed is then passed into a hydroprocessing reaction stage 120. Note that hydrogen stream 106 could be introduced directly into hydroprocessing reaction stage 120. Hydroprocessing reaction stage 120 is shown as a separate reactor in FIG. 1. Alternatively, the hydroprocessing reaction stage and catalytic dewaxing reaction stage in FIG. 1 could be combined, if convenient into a single reactor. Still another option could be to have multiple reactors (2, 3, 4 or more) that correspond to a single reaction stage.

The effluent 121 from hydroprocessing reaction stage 120 can be cascaded, with or without intermediate separation, to a catalytic dewaxing reaction stage 130. As shown in FIG. 1, a portion 122 of the effluent from the dewaxing stage can also be recycled. The catalytic dewaxing stage 130 can be operated under either sweet or sour conditions. The effluent 131 from the dewaxing stage 130 can then be hydrofinished in a hydrofinishing stage 140. Optionally, additional hydrogen can be provided to dewaxing stage 130 and/or to hydrofinishing stage 140 via hydrogen inputs 136 and 146, respectively. The product 141 from hydrofinishing can then be fractionated in a fractionator 150 to produce at least a portion suitable for use as a lubricant basestock. The lubricant basestock portion can correspond to a bottoms portion 151 from fractionator 150. Alternatively, the effluent 131 from the dewaxing stage 130 can then be fractionated in a fractionator 150 prior to being hydrofinished in a hydrofinishing stage 140.

Figure 2:
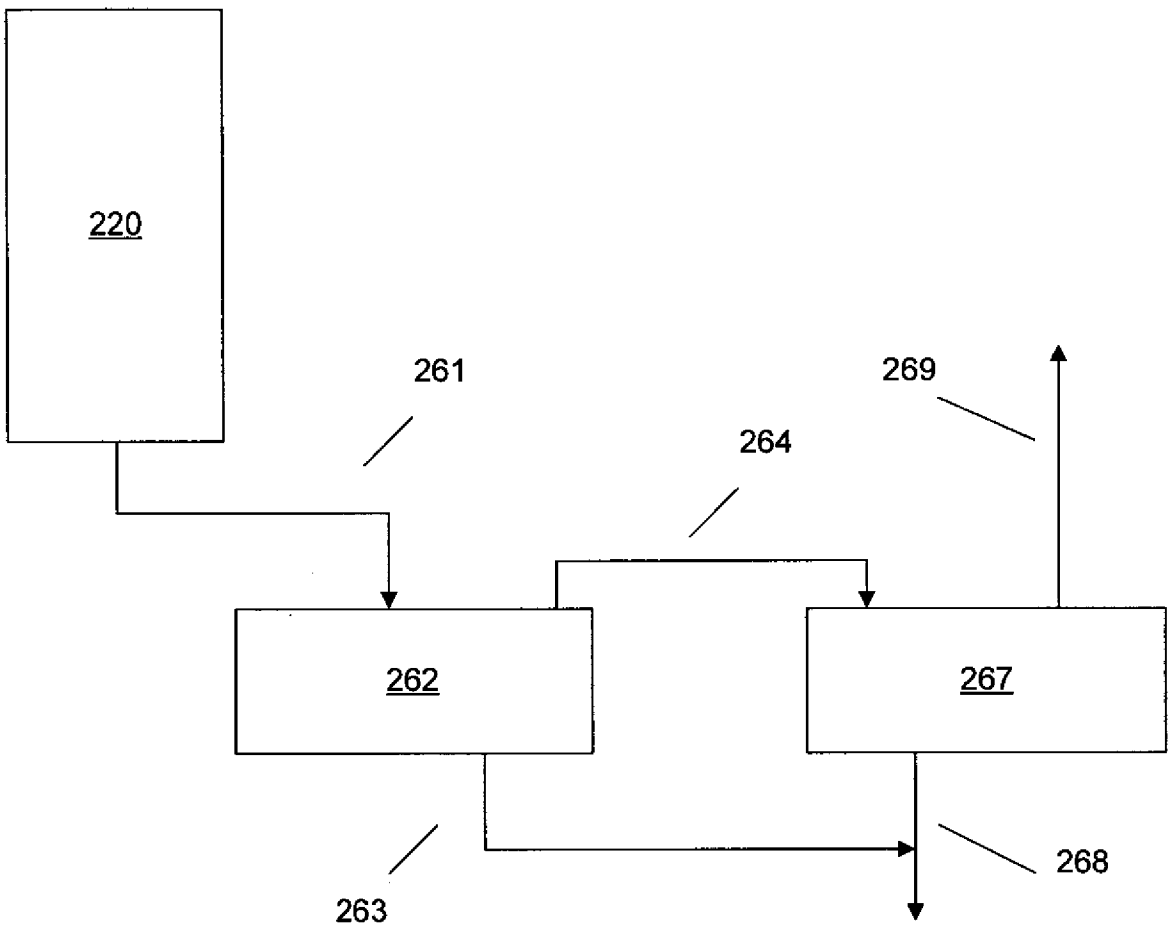
FIG. 2 schematically shows a reaction system for performing a process according to an embodiment of the disclosure with interstage separation between hydroprocessing and dewaxing steps.

The configuration shown in FIG. 1 shows one example of how the various stages can be organized. In other embodiments, variations can be made in the order of the reaction stages. One variation relates to whether a separator is included after a hydroprocessing stage. FIG. 2 schematically shows inclusion of a high pressure separation stage after a hydroprocessing stage 220. In FIG. 2, the effluent 261 from hydroprocessing stage 220 is passed into a first high pressure separator 262. This produces a liquid product 263 and a gas phase product 264. The gas phase product is then cooled (not shown) and passed through a second high pressure separator 267. The gas phase product 269 from the second high pressure separator 267 can be sent to a sour gas processing stage to separate out $NH_3$ and $H_2S$ from unreacted hydrogen. The liquid product 268 from the second high pressure separator can be combined with liquid product 263 and passed to the next stage in the reaction system, such as a dewaxing stage. It is noted that a high pressure separation stage may not fully remove gas phase sulfur and/or nitrogen from the effluent of a hydroprocessing stage if the initial feed concentration of sulfur and/or nitrogen is sufficiently high. Thus, some embodiments of the disclosure provide the advantage of being able to select an initial feedstock having a high sulfur and/or nitrogen concentration. Even if some sulfur remains in the feed after the hydroprocessing and separation stages, a method according to the disclosure can be used to effectively perform catalytic dewaxing on the feed. The high pressure separation stage may optionally include to a stripper and/or fractionator before or after the high pressure separator.

Additional Embodiments

In a first embodiment, a method is provided for producing a lube basestock. The method includes providing a process train including a first catalyst that is a hydroprocessing catalyst, and a second catalyst that is a dewaxing catalyst. A first feedstock is processed in the process train at first hydrotreating conditions and first catalytic dewaxing conditions to produce a basestock having a pour point less than about −15° C. and a total liquid product 700°+F (371° C.) yield, employing the inventive catalyst, similar or better than that produced by employing a conventional dewaxing catalyst for a sweet dewaxing stage, and at least 10 wt % higher yield, or at least 15 wt % higher yield, or at least 17 wt % higher yield than that produced by employing a conventional dewaxing catalyst for a sour dewaxing stage. The first catalytic dewaxing conditions including a temperature of about 400° C. or less, and the first hydroprocessed feedstock has a first sulfur content when exposed to the dewaxing catalyst of greater than, less than, or equal to about 1000 wppm on a combined liquid sulfur and gas phase sulfur basis. Any and all subsequent feedstocks are processed in the same process train at subsequent hydroprocessing conditions and subsequent catalytic dewaxing conditions. The subsequent hydrotreated feedstock having a sulfur content when exposed to the dewaxing catalyst of greater than, less than, or equal to about 1000 wppm on a combined liquid sulfur and gas phase sulfur basis. This produces a subsequent basestock having a pour point less than about −15° C. and a total liquid product 700°+F (371° C.) yield, employing the inventive catalyst, similar or better than that produced by employing a conventional dewaxing catalyst for a sweet dewaxing stage, and at least 10 wt % higher yield, or at least 15 wt % higher yield, or at least 17 wt % higher yield than that produced by employing a conventional dewaxing catalyst for a sour dewaxing stage. The subsequent catalytic dewaxing conditions include a temperature of about 400° C. or less, and the subsequent to catalytic dewaxing temperature differs from the first catalytic dewaxing temperature by about 50° C. or less.

In a second embodiment, a method according to any of the above embodiments is provided, wherein the dewaxing catalyst comprises ZSM-48 with a $SiO_2$:$Al_2O_3$ ratio of from about 30:1 to 200:1 and a framework alumina content of from about 0.1 wt % to about 2.7 wt %.

In a third embodiment, a method according to any of the above embodiments is provided, wherein the dewaxing catalyst comprises from about 0.1 wt % to about 5 wt % of a Group VIII metal.

In a fourth embodiment, a method according to the third embodiment is provided, wherein the Group VIII metal is Pt, Pd, or a combination thereof.

In a fifth embodiment, a method according to any of the above embodiments is provided, wherein the dewaxing catalyst has a micropore surface area that is at least about 25% of a total catalyst surface area.

In a sixth embodiment, a method according to any of the above embodiments is provided, wherein the dewaxing catalyst is not dealuminated.

In an seventh embodiment, a method according to any of the above embodiments is provided, wherein the total liquid product yield for the first basestock and any subsequent basestock is similar or higher than that produced by employing a conventional catalyst for sweet stages and at least 5 wt % higher, or at least 10 wt % higher, or at least 15 wt % higher for sour stages.

In a eighth embodiment, a method according to any of the above embodiments is provided, wherein the hydroprocessing conditions include a temperature of from about 150° C. to about 400° C., more preferably about 200° C. to about 350° C., a hydrogen partial pressure of from about 1480 kPa to about 20786 to kPa (200 to 3000 psig), preferably about 2859 kPa to about 13891 kPa (400 to 2000 psig), a space velocity of from about 0.1 $hr^{-1}$ to about 10 $hr^{-1}$, preferably about 0.1 $hr^{-1}$ to about 5 $hr^{-1}$. % and a hydrogen to feed ratio of from about 89 $m^3/m^3$ to about 1780 $m^3/m^3$ (500 to 10000 scf/B), preferably about 178 $m^3/m^3$ to about 890 $m^3/m^3$.

In an ninth embodiment, a method according to any of the first through seventh embodiments is provided, wherein the hydroprocessing conditions comprise raffinate hydroconversion conditions, including include a temperature of from about 320° C. to about 420° C., preferably about 340° C. to about 400° C., a hydrogen partial pressure of about 800 psig to about 2500 psig (5.6 to 17.3 MPa), preferably about 800 psig to about 2000 psig (5.6 to 13.9 MPa), a space velocity of from about 0.2 $hr^{-1}$ to about 5.0 $hr^{-1}$ LHSV, preferably about 0.3 $hr^{-1}$ to about 3.0 $hr^{-1}$ LHSV and a hydrogen to feed ratio of from about 500 scf/B to about 5000 scf/B (89 to 890 $m^3/m^3$), preferably about 2000 scf/B to about 4000 scf/B (356 to 712 $m^3/m^3$).

In an tenth embodiment, a method according to any of the above embodiments is provided, further comprising exposing the hydroprocessed, dewaxed, feedstock to a third catalyst under conditions effective for hydrofinishing or aromatic saturation.

In a eleventh embodiment, a method according to the tenth embodiment is provided, wherein the effective hydrofinishing or aromatic saturation conditions include temperatures from about 150° C. to about 350° C., preferably about 180° C. to about 250° C., total pressures from about 2859 kPa to about 20786 kPa (400 to 3000 psig), a liquid hourly space velocity (LHSV) from about 0.1 $hr^{-1}$ to about 5 $hr^{-1}$, preferably about 0.5 $hr^{-1}$ to about 3 $hr^{-1}$, and hydrogen treat gas rates of from about 44.5 $m^3/m^3$ to about 1780 $m^3/m^3$ (250 to 10,000 scf/B).

In a twelfth embodiment, a method according to the tenth embodiment is provided, wherein the hydroprocessed, dewaxed feedstock is fractionated prior to being exposed to the third catalyst.

In a thirteenth embodiment, a method according to any of the above embodiments is provided, wherein processing a feedstock includes exposing the feedstock to the first catalyst under hydroprocessing conditions to produce a hydroprocessed effluent, the hydroprocessed effluent including at least a liquid effluent and $H_2S$. The hydroprocessed effluent is separated to remove at least a portion of the $H_2S$. The separated hydroprocessed effluent is then exposed to the dewaxing catalyst under catalytic dewaxing conditions.

In a fourteenth embodiment, a method according to the thirteenth embodiment is provided, wherein the separated hydroprocessed effluent includes at least about 1000 vppm of $H_2S$.

In a fifteenth embodiment, a method according to any of the above embodiments is provided, wherein the pour point for the first basestock and/or the second basestock is at about −15° C. or less, or about −18° C. or less.

In a sixteenth embodiment, a method according to any of the above embodiments is provided, wherein the subsequent catalytic dewaxing temperature differs from the first catalytic dewaxing temperature by about 50° C. or less, or about 40° C. or less, or about 30° C. or less.

In a seventeenth embodiment, a method for producing a lube basestock, includes: providing a process train including a first catalyst that is a hydroprocessing catalyst, and a second catalyst that is a dewaxing catalyst, wherein the dewaxing catalyst includes at least one non-dealuminated, unidimensional 10-member ring pore zeolite and at least one Group VIII metal; processing a first feedstock in the process train at first hydroprocessing conditions and first catalytic dewaxing conditions to produce a lube basestock having a pour to point less than −15° C. and a total liquid product 700°+F (371° C.) yield of at least 75 wt %, the first catalytic dewaxing conditions including a temperature of 400° C. or less, the first feedstock having a first sulfur content when exposed to the dewaxing catalyst of 1000 wppm or less on a total sulfur basis; processing a second feedstock in the same process train at second hydroprocessing conditions and second catalytic dewaxing conditions, the second feedstock having a sulfur content when exposed to the dewaxing catalyst of greater than 1000 wppm on a total sulfur basis, to produce a second lube basestock having a pour point less than −15° C. and a total liquid product yield of at least 75 wt %, wherein the second catalytic dewaxing conditions include a temperature of 400° C. or less with the second catalytic dewaxing temperature being from 20 to 50° C. greater than first catalytic dewaxing temperature, and wherein the processing of the first feedstock and the processing of the second feedstock are alternated in any sequence as a function of time.

In a eighteenth embodiment, a method according to the seventeenth embodiment, wherein the dewaxing catalyst includes at least one low surface area metal oxide refractory binder having a surface area of 100 $m^2/g$ or less.

In a nineteenth embodiment, a method according to the seventeenth to eighteenth embodiments, further including providing a high pressure separator between the first hydroprocessing step and the first dewaxing step, and passing a first hydroprocessed effluent including at least a liquid effluent and $H_2S$ from the first hydroprocessing step to the high pressure separator to remove at least a portion of the $H_2S$ prior to the first dewaxing step.

In a twentieth embodiment, a method according to the seventeenth to nineteenth embodiments, further including providing a high pressure separator between the second hydroprocessing step and the second dewaxing step, and passing a second hydroprocessed effluent including at least a liquid effluent and $H_2S$ from the second hydroprocessing step to the high pressure separator to remove at least a portion of the $H_2S$ prior to the second dewaxing step.

In a twenty-first embodiment, a method according to the seventeenth to twentieth embodiments, wherein the first and second feedstocks are chosen from a hydrocracker bottoms, a previously hydroprocessed stream, a raffinate, a wax and combinations thereof.

In a twenty-second embodiment, a method according to the seventeenth to twenty-first embodiments, wherein the first and second hydrotreating conditions are under effective hydroprocessing conditions chosen from hydroconversion, hydrocracking, hydrotreatment, hydrofinishing and dealkylation.

In a twenty-third embodiment, a method according to the seventeenth to twenty-second embodiments, further comprising hydrofinishing the first and second lube basestock under effective hydrofinishing conditions for hydrofinishing or aromatic saturation.

In a twenty-fourth embodiment, a method according to the seventeenth to twenty-third embodiments further comprising fractionating the first and second lube basestock under effective fractionating conditions.

In a twenty-fifth embodiment, a method according to the seventeenth to twenty-fourth embodiments, further comprising hydrofinishing the fractionated first and second tube basestock under effective hydrofinishing conditions for hydrofinishing or aromatic saturation.

In a twenty-sixth embodiment, a method according to the seventeenth to twenty-fifth embodiments, wherein the hydroprocessing and dewaxing steps occur in a single reactor.

In a twenty-seventh embodiment, a method according to the seventeenth to twenty-sixth embodiments, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

In a twenty-eighth embodiment, a method according to the seventeenth to twenty-seventh embodiments, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

In a twenty-ninth embodiment, a method according to the seventeenth to twenty-eighth embodiments, wherein the molecular sieve is EU-2, EU-11, ZBM-30, ZSM-48, ZSM-23, or a combination thereof.

In a thirtieth embodiment, a method according to the seventeenth to twenty-ninth embodiments, wherein the molecular sieve is ZSM-48.

In a thirty-first embodiment, a method according to the seventeenth to thirtieth embodiments, wherein the dewaxing catalyst includes at least one low surface area metal oxide refractory binder having a surface area of 50 $m^2/g$ or less.

In a thirty-second embodiment, a method according to the seventeenth to thirty-first embodiments, wherein the dewaxing catalyst comprises a micropore surface area to total surface area of greater than or equal to 25%, wherein the total surface area equals the surface area of the external zeolite.

In a thirty-third embodiment, a method according to the seventeenth to thirty-second embodiments, wherein the dewaxing catalyst comprises a micropore surface area to total surface area of greater than or equal to 25%, where the total surface area equals the surface area of the external zeolite plus the surface area of the binder.

In a thirty-fourth embodiment, a method according to the seventeenth to thirty-third embodiments, wherein the binder is silica, alumina, titania, zirconia, silica-alumina, or combinations thereof.

In a thirty-fifth embodiment, a method according to the seventeenth to thirty-fourth embodiments, wherein the dewaxing catalyst comprises from 0.1 wt % to 5 wt % of the at least one Group VIII metal.

In a thirty-sixth embodiment, a method according to the seventeenth to thirty fifth embodiments, wherein the at least one Group VIII metal is platinum.

In a thirty-seventh embodiment, a method for producing a lube basestock, comprising: providing a feedstock including sulfur in the range from 0.005 wt % to 5 wt %, a process train including a first catalyst that is a hydroprocessing catalyst, and a second catalyst that is a dewaxing catalyst, a real-time hydroprocessed effluent sulfur monitor, and a process controller for controlling the temperature of the second catalyst as a function of the sulfur level in the hydroprocessed effluent, wherein the dewaxing catalyst includes at least one non-dealuminated, unidimensional 10-member ring pore zeolite and at least one Group VIII metal; monitoring the sulfur level of the hydroprocessed effluent using the sulfur monitor followed by controlling the dewaxing catalyst temperature as a function of the sulfur level of the hydroprocessed effluent using the process controller; processing the feedstock in the process train at effective hydroprocessing conditions and effective catalytic dewaxing conditions sufficient to produce a lube basestock having a pour point less than −15° C. and a total liquid product 700°+F (371° C.) yield of at least 75 wt %; and wherein the process controller increases the temperature of the dewaxing catalyst with increasing sulfur level in the hydroprocessed effluent up to a maximum of 400° C.

In a thirty-eighth embodiment, a method according to the thirty-seventh embodiment, wherein the dewaxing catalyst includes at least one low surface area metal oxide refractory binder having a surface area of 100 $m^2/g$ or less.

In a thirty-ninth embodiment, a method according to the thirty-seventh to thirty-eighth embodiments further including providing a high pressure separator and/or stripper between the hydroprocessing step and the dewaxing step, and passing the hydroprocessed effluent including at least a liquid effluent and $H_2S$ from the hydroprocessing step to the high pressure separator and/or stripper to remove at least a portion of the $H_2S$ prior to the dewaxing step.

In a fortieth embodiment, a method according to the thirty-seventh to thirty-ninth embodiments, wherein the feedstock is chosen from a hydrocracker bottoms, a raffinate, a wax, a previously hydroprocessed feed, and combinations thereof.

In a forty-first embodiment, a method according to the thirty-seventh to fortieth embodiments, wherein the hydroprocessing conditions are under effective hydroprocessing conditions chosen from hydroconversion, hydrocracking, hydrotreatment, hydrofinishing, aromatic saturation and dealkylation.

In a forty-second embodiment, a method according to the thirty-seventh to forty-first embodiments, further comprising hydrofinishing the lube basestock under effective hydrofinishing conditions for hydrofinishing or aromatic saturation.

In a forty-third embodiment, a method according to the thirty-seventh to forty-second embodiments, further comprising fractionating the lube basestock under effective fractionating conditions.

In a forty-fourth embodiment, a method according to the thirty-seventh to forty-third embodiments, wherein the hydroprocessing and catalytic dewaxing steps occur in a single reactor.

In a forty-fifth embodiment, a method according to the thirty-seventh to forty-forth embodiments further comprising hydrofinishing the fractionated lube basestock under effective hydrofinishing conditions for hydrofinishing or aromatic saturation.

In a forty-sixth embodiment, a method according to the thirty-seventh to forty-fifth embodiments, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

In a forty-seventh embodiment, a method according to the thirty-seventh to forty-sixth embodiments, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

In a forty-eighth embodiment, a method according to the thirty-seventh to forty-seventh embodiments, wherein the molecular sieve is EU-2, EU-11, ZBM-30, ZSM-48, ZSM-23, or a combination thereof.

In a forty-ninth embodiment, a method according to the thirty-seventh to forty-eighth embodiments, wherein the molecular sieve is ZSM-48.

In a fiftieth embodiment, a method according to the thirty-seventh to forty-ninth embodiments, wherein the dewaxing catalyst includes at least one low surface area metal oxide refractory binder having a surface area of 50 $m^2/g$ or less.

In a fifty-first embodiment, a method according to the thirty-seventh to fiftieth embodiments, wherein the dewaxing catalyst comprises a micropore surface area to total surface area of greater than or equal to 25%, wherein the total surface area equals the surface area of the external zeolite.

In a fifty-second embodiment, a method according to the thirty-seventh to fifty-first embodiments, wherein the dewaxing catalyst comprises a micropore surface area to total surface area of greater than or equal to 25%, where the total surface area equals the surface area of the external zeolite plus the surface area of the binder.

In a fifty-third embodiment, a method according to the thirty-seventh to fifty-second embodiments, wherein the binder is chosen from silica, alumina, titania, zirconia, silica-alumina, and combinations thereof.

In a fifty-fourth embodiment, a method according to the thirty-seventh to fifty-third embodiments, wherein the dewaxing catalyst comprises from 0.1 wt % to 5 wt % of the at least one Group VIII metal.

In a fifty-fifth embodiment, a method according to the thirty-seventh to fifty-fourth embodiments, wherein the at least one Group VIII metal is platinum.

In a fifty-sixth embodiment, a method according to the thirty-seventh to fifty-fifth embodiments, wherein the process controller controls the temperature of the dewaxing catalyst over a range of 1 to 50° C. as a function of sulfur level in the hydroprocessed effluent.

EXAMPLES

Process Examples 1-5

Catalyst, Feed and Process Conditions

Table 1 below provides a description of the various 130N Raffinate Hydroconversion (RHC) Product feeds employed. In some cases the feed was spiked with Sulfrzol 54 and Octylamine to simulate no separation stage between the hydrotreatment stage and dewaxing stage (Simulated Direct Cascade) or with at least one high pressure separation stage between the hydrotreatment stage and dewaxing stage (Simulated High-Pressure Separation).

Table 2 below provides the parameters of the various dewaxing catalysts employed.

Table 3 below provides the description of the various dewaxing catalysts employed.

Table 4 below provides the preliminary lubricant basestock specifications.

TABLE 1

| 130N Feed Description | Spiked 130N RHC Product* (Simulated Direct Cascade) | Spiked 130N RHC Product* (Simulated Medium Severity, High-Pressure Separation) | 130N RHC Product |
|---|---|---|---|
| 700° F.+ (371° C.+) in Feed (wt %) | 96 | 97 | 97 |
| Solvent Dewaxed Oil Feed Pour Point, ° C. | −18 | −12 | −18 |
| Solvent Dewaxed Oil Feed 100° C. Viscosity, cSt | 4.2 | 4.5 | 4.2 |
| Solvent Dewaxed Oil Feed VI | 119 | 118 | 119 |
| Organic Sulfur in Feed (ppm by weight) | 7,278.4 | 1,512 | <5 |
| Organic Nitrogen in Feed (ppm by weight) | 48.4 | 11 | <5 |
| Experiment Number | 1 | 3 | 2, 4, 5 |

*130N Raffinate Hydroconversion (RHC) Product spiked with Sulfrzol 54 and Octylamine

TABLE 2

| Experiment | Catalyst | Catalyst Parameters |
|---|---|---|
| 1 | 0.9% Pt/33% ZSM-48(90:1 $SiO_2$:$Al_2O_3$)/67% P25 $TiO_2$ | 0.9 wt % Pt/0.37 wt % Framework $Al_2O_3$/67 wt % P25 $TiO_2$ |
| 2 | 0.9% Pt/33% ZSM-48(90:1 $SiO_2$:$Al_2O_3$)/67% P25 $TiO_2$ | 0.9 wt % Pt/0.37 wt % Framework $Al_2O_3$/67 wt % P25 $TiO_2$ |
| 3 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |
| 4 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |
| 6 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |

TABLE 3

| Experiment | Catalyst | Micropore surface area, $m^2/g$ | BET Total surface area, $m^2/g$ | Micropore surface area/ Total surface area, % | Density, g/cc |
|---|---|---|---|---|---|
| 1 | 0.9% Pt/33% ZSM-48(90:1 $SiO_2$:$Al_2O_3$)/67% P25 $TiO_2$ | 67 | 148 | 45% | 0.87 |
| 2 | 0.9% Pt/33% ZSM-48(90:1 $SiO_2$:$Al_2O_3$)/67% P25 $TiO_2$ | 67 | 148 | 45% | 0.87 |
| 3 | 0.6% Pt/steamed/65% ZSM-48(90:1 $SiO_2$:$Al_2O_3$)/35% Versal-300 Alumina | 50 | 232 | 22% | 0.5 |
| 4 | 0.6% Pt/steamed/65% ZSM-48(90:1 $SiO_2$:$Al_2O_3$)/35% Versal-300 Alumina | 50 | 232 | 22% | 0.5 |
| 5 | 0.6% Pt/steamed/65% ZSM-48(90:1 $SiO_2$:$Al_2O_3$)/35% Versal-300 Alumina | 50 | 232 | 22% | 0.5 |

Process Experiment #1 was conducted under the following conditions: Simulated RHC-Dewaxing integrated process using a spiked 130N RHC product feed as shown in Table I. Catalytic dewaxing conditions: catalyst-100 cc 0.9% Pt/33% ZSM-48 (90:1 $SiO_2$:$Al_2O_3$)/67% P25 $TiO_2$, 1800 psig, 1 LHSV, 2500 SCF/B for hydrogen gas to feed ratio, Temperature=349° C. at total liquid product pour point of −20° C. The catalyst was loaded into the reactor by volume.

Process Experiment #2 was conducted under the following conditions: Simulated RHC-hot separation and stripping-Dewaxing process using a Clean 130N RHC product feed as shown in Table 1. Catalytic dewaxing conditions: catalyst-100 cc 0.9% Pt/33% ZSM-48 (90:1 $SiO_2$:$Al_2O_3$)/67% P25 $TiO_2$, 1800 psig, 1 LHSV, 2500 SCF/B for hydrogen gas to feed ratio, Temperature=325° C. at total liquid product pour point of −20° C. The catalyst was loaded into the reactor by volume.

Process Experiment #3 (comparative example) was conducted under the following conditions: Simulated RHC-hot separation-Dewaxing process using a spiked 130N RHC product feed as shown in Table I. Catalytic dewaxing conditions: catalyst-10 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, Temperature=335° C. at total liquid product pour point of −20° C. This comparative experiment shows that the conventional catalyst does not maintain yield in a sour environment. The catalyst was loaded into the reactor by volume.

Process Experiment #4 (comparative example) was conducted under the following conditions: Simulated RHC-hot separation and stripping-Dewaxing process using a Clean 130N RHC product feed as shown in Table I. Catalytic dewaxing conditions: catalyst-10 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, Temperature=315° C. at total liquid product pour point of −20° C. This comparative experiment shows 700° F.+ lube yield for a clean service process for comparison to inventive sour service processes disclosed herein. The catalyst was loaded into the reactor by volume.

Process Experiment #5 (comparative example) was conducted under the following conditions: Simulated RHC-hot separation and stripping-Dewaxing process using a Clean 130N RHC product feed as shown in Table I. Catalytic dewaxing conditions: catalyst-100 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, Temperature=310° C. at total liquid product pour point of −20° C. This comparative experiment shows 700° F.+ lube yield for a clean service process for comparison to inventive sour service processes disclosed herein. The catalyst was loaded into the reactor by volume.

Process Experiments 1 and 2 are directed to hydroprocessing of a lubricant feed under sour and sweet conditions respectively using a method and dewaxing catalyst according to the disclosure. In Experiments 1 and 2, a dewaxing catalyst was used that included ZSM-48 bound with a titanium binder. All weight percentages below are based on the total weight of the catalyst. The silica to alumina ratio of the ZSM-48 was between about 70 and about 110. The ZSM-48 included about 0.37 wt % of framework alumina. The catalyst also included 0.9 wt % of Pt. The bound catalyst had a micropore surface area that was about 45% of the total surface area of the bound catalyst. The catalyst density was approximately 0.9 g/mL.

The above catalyst was used in a 100 cc pilot plant to perform catalytic dewaxing on a hydrocarbon feed under sweet and sour conditions. Experiment 1 corresponds to processing under sour conditions, while Experiment 2 corresponds to processing under sweet conditions. The same catalyst load used for the process in Experiment 1 was also used for the process in Experiment 2.

The feeds in Process Experiments 1 and 2 were based on a hydroconverted or hydrotreated 130N raffinate feed. For Experiment 2, the hydroconverted raffinate product was used as the feed. The hydroconverted raffinate product contained about 5 wppm or less of sulfur and about 5 wppm or less of nitrogen. The weight percentage of the feed boiling at a temperature greater than 700° F. (371° C.) was 97%. After solvent dewaxing, the hydroconverted raffinate product had a pour point of −18° C., a viscosity at 100° C. of 4.2 cSt, and a VI of 119. For Experiment 2, this sweet feed represents a feed that has been hydrotreated in a previous stage and then separated to remove gas phase sulfur and nitrogen contaminants.

For Process Experiment 1, the hydroconverted raffinate product was spiked with Sulfrzol® 54 and octylamine to produce a feed with 7278 wppm of sulfur and 48.4 wppm of nitrogen. The addition of the sulfur and nitrogen compounds did not modify the solvent dewaxed properties of the feed. However, the 700° F.+ portion of the feed was reduced to 96.4 wt %. The sulfur and nitrogen content of the feed was selected to represent a situation where a feed with high sulfur and nitrogen content was directly cascaded from a hydrotreatment stage to a dewaxing stage. Such a situation could arise, for example, due to a failure of operation in a separator unit. Alternatively, Experiment 1 could correspond to a situation where an upset occurs in the hydrotreatment reactor, leading to incomplete desulfurization of a feed.

It is noted that Process Experiments 1 and 2 were performed consecutively using the same dewaxing catalyst load. As a result, Process Experiments 1 and 2 correspond to a situation where feeds of differing sulfur and/or nitrogen content are dewaxed in block operation. The differing sulfur contents in Experiments 1 and 2 can correspond to a change in the effectiveness of the hydrotreatment and/or separation stages, or the differing sulfur contents can reflect a change in the sulfur and/or nitrogen content of the initial feeds.

Process Experiments 3, 4 and 5 are directed to hydroprocessing of a lubricant feed under sweet and sour conditions using a method and dewaxing catalyst outside of the scope of the disclosure. In the Comparative Example provided by Experiments 3, 4 and 5, a dewaxing catalyst is used that includes ZSM-48 bound with an alumina binder. The silica to alumina ratio of the ZSM-48 is between about 70 and about 110. The ZSM-48 includes about 0.7 wt % of framework alumina. The catalyst also includes 0.6 wt % of Pt. The bound catalyst has a micropore surface area that is about 20 to about 25% of the total surface area. The catalyst density was approximately 0.5 g/mL.

The feed for Process Experiments 4 and 5 is the same hydroconverted raffinate feed used in Process Experiment 2. For Process Experiment 3, the hydroconverted raffinate feed was spiked to produce a lower level of sulfur and nitrogen than the feed used in Process Experiment 1. In Process Experiment 3, the hydroconverted raffinate was spiked to produce a feed with 1512 wppm of sulfur and 11 wppm of nitrogen. This could represent, for example, an amount of sulfur and nitrogen remaining in the effluent from a hydrotreatment stage after performing a high pressure separation on the effluent. Note that the catalyst in the 10 cc reactor was replaced after completing the process of Process Experiment 3, due to the lower sulfur tolerance of the catalyst used in these Comparative Examples.

Results from Process Experiments 1-5

TABLE 4

| Preliminary Lube Basestock Specifications | Experiment 1 | Experiment 2 | Experiment 3 | Experiment 4 | Experiment 5 |
|---|---|---|---|---|---|
| 700° F.+ (371° C.+) Lube Yield (wt %) at Total Liquid Product Pour Point of −20° C. | 87 | 90.3 | 74.4 | 85 | 89.4 |
| 700° F.+ (371° C.+) Lube Pour Point, ° C. | −20 | −20 | −18 | −18 | −15 |
| 700° F.+ (371° C.+) Lube 100° C. Viscosity, cSt | 4.3303 | 4.1595 | 4.457 | 4.249 | 4 |
| 700° F.+ (371° C.+) Lube VI | 123.6 | 126.1 | 114 | 121.7 | 123 |
| 700° F.+ (371° C.+) Lube % Saturates (wt %)* | 99* | 99.9* | 99.4** | 99.9** | 99.9** |

*% Saturates (wt %) = [1 − (Total Aromatics of 700° F.+ (371° C.+) Lube (moles/gram)*Calculated Molecular Weight)]*100 where Molecular Weight is calculated based on Kinematic Viscosity at 100° C. and 40° C. of the 700° F.+ (371° C.+) Lube.
**% Saturates (wt %) = [1 − (Total Aromatics of Total Liquid Product (moles/gram)*Calculated Molecular Weight)]*100 where Molecular Weight is calculated based on Kinematic Viscosity at 100° C. and 40° C. of the 700° F.+ (371° C.+) Lube.

Table 4 shows the preliminary lubricant basestock specifications for process experiments 1 through 5. The catalyst employed in process experiments 1 and 2 showed high 700° F.+ (371° C.+) lubricant yield greater than 85 wt % for both sour and sweet stages. In contrast, the comparative examples shown in process experiments 3 and 4 showed a lower 700° F.+ (371° C.+) lubricant yield (74.4 wt %) for the sour stage than for the sweet stage (85 wt %). The sour stage conditions for experiment 1 were 4-5 times more severe than the conditions for process experiment 3.

Figure 3:
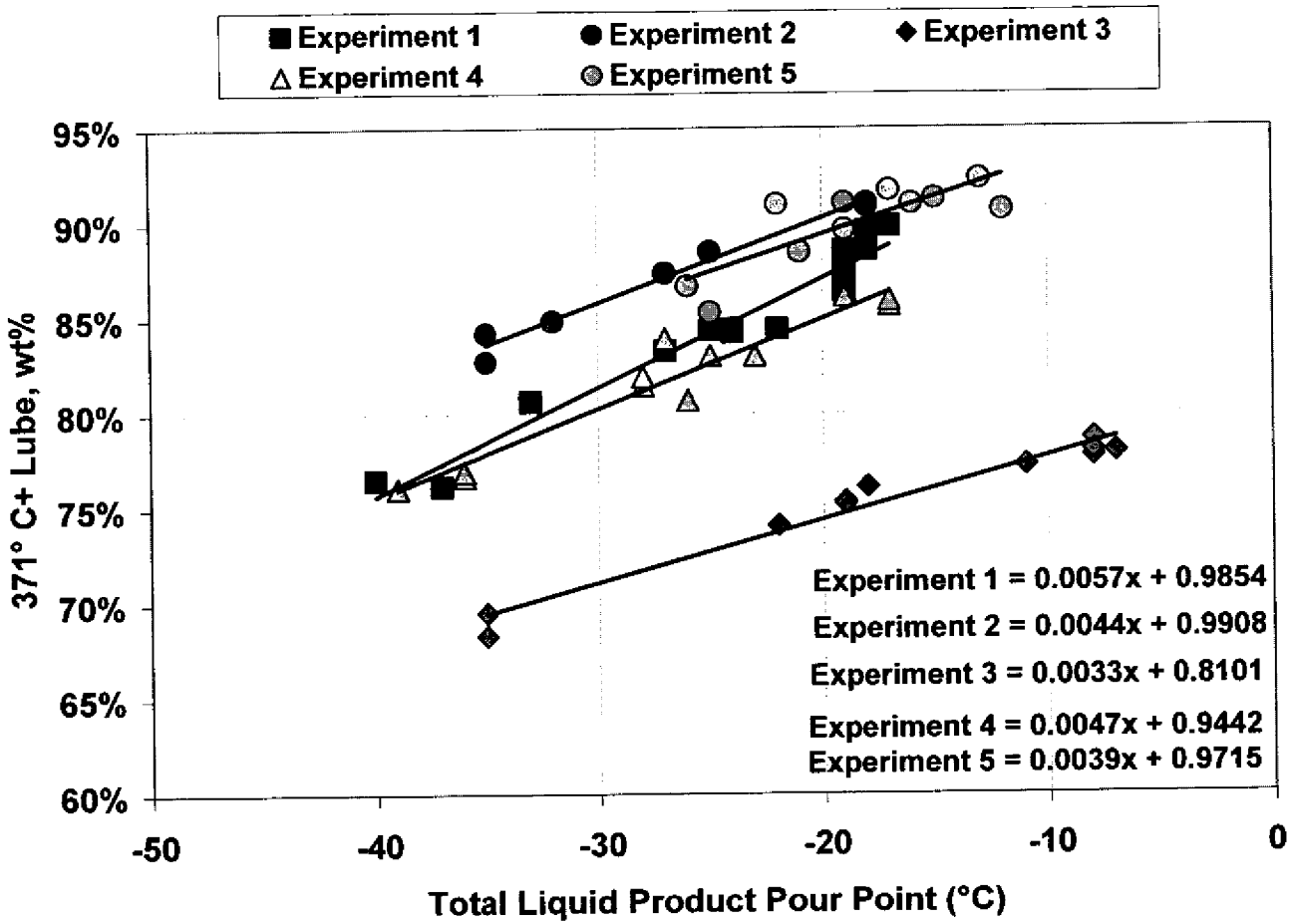
FIG. 3 shows results for processing of various feeds.

FIG. 3 shows the results from the processing runs corresponding to Experiments 1-5. In FIG. 3, the 700°+F (371°+C) lube yield is shown at various total liquid product pour points. As shown in FIG. 3, the best combination of lube yield and pour point was achieved by Experiment 2, corresponding to a catalyst according to the disclosure under sweet conditions. The results from Process Experiment 1, under sour conditions, show only a marginal decline in yield relative to Process Experiment 2. The yield versus pour point results from Experiment 1 show that a catalyst according to the disclosure can be used to process lubricant boiling range feeds under sweet or sour conditions. Note that the results from Process Experiment 1 (sour conditions) are somewhat similar to the results from Process Experiments 4 and 5 (sweet conditions).

As shown by Process Experiment 3, using mild conditions with a catalyst not according to the disclosure resulted in a sharp drop in yield at a comparable pour point. This likely indicates a relative increase in the rate for cracking reactions versus isomerization reactions for the catalyst used in Process Process Experiment 3. By contrast, the sour conditions in Process Experiment 1 resulted in only a modest loss in yield relative to sweet conditions. This contrast is further highlighted by the difference between the sour conditions in Process Experiments 1 and 3. The sulfur and nitrogen levels in Process Experiment 1 were 4-5 times greater than the sulfur and nitrogen levels in Process Experiment 3. In spite of the much greater contaminant levels, the catalyst in Process Experiment 1 (according to the disclosure) performed substantially better than the catalyst in Process Experiment 3 (comparative example).

Catalyst Examples 1-8 with Low Surface Area Binders

Catalyst Example 1

0.6 wt % Pt (IW) on 65/35 ZSM-48(90/1 $SiO_2$:$Al_2O_3$)/$TiO_2$

65% ZSM-48(90/1 $SiO_2$:$Al_2O_3$) and 35% Titania were extruded to a 1/16" quadrulobe. The extrudate was pre-calcined in $N_2$ @1000° F., ammonium exchanged with 1N ammonium nitrate, and then dried at 250° F., followed by calcination in air at 1000° F. The extrudate was then was loaded with 0.6 wt % Pt by incipient wetness impregnation with platinum tetraammine nitrate, dried at 250° F., and calcined in air at 680° F. for 3 hours. Table 5 provides the surface area of the extrudate via $N_2$ porosimetry.

A batch micro-autoclave system was used to determine the activity of the above catalyst. The catalyst was reduced under hydrogen followed by the addition of 2.5 grams of a 130N feed (cloud point 31). The reaction was run at 400 psig at 330° C. for 12 hours. Cloud points were determined for two feed space velocities. Results are provided in Table 6.

Catalyst Example 2

0.6 wt % Pt(IW) on 65/35 ZSM-48(90/1 $SiO_2$:$Al_2O_3$)/$Al_2O_3$ (Comparative)

65% ZSM-48(90/1 $SiO_2$:$Al_2O_3$) and 35% Versal-300 $Al_2O_3$ were extruded to a 1/16" quadrulobe. The extrudate was pre-calcined in $N_2$ @1000° F., is ammonium exchanged with 1N ammonium nitrate, and then dried at 250° F. followed by calcination in air at 1000° F. The extrudate was then steamed (3 hours at 890° F.). The extrudate was then loaded with 0.6 wt % Pt by incipient wetness impregnation with platinum tetraammine nitrate, dried at 250° F., and calcined in air at 680° F. for 3 hours. Table 5 provides the surface area of the extrudate via $N_2$ porosimetry.

A batch micro-autoclave system was used to determine the activity of the above catalyst. The catalyst was reduced under hydrogen followed by the addition of 2.5 grams of a 130N feed. The reaction was run at 400 psig at 330° C. for 12 hours. Cloud points were determined for two feed space velocities. Results are provided in Table 6.

Catalyst Example 3

0.6 wt % Pt(IW) on 80/20 ZSM-48(90/1 $SiO_2$:$Al_2O_3$)/$SiO_2$

80% ZSM-48(90/1 $SiO_2$:$Al_2O_3$) and 20% $SiO_2$ were extruded to 1/16" quadrulobe. The extrudate was pre-calcined in $N_2$ @1000° F., ammonium exchanged with 1N ammonium nitrate, and then dried at 250° F. followed by calcination in air at 1000° F. The extrudate was then loaded with 0.6 wt % Pt by incipient wetness impregnation with platinum tetraammine nitrate, dried at 250° F., and calcined in air at 680° F. for 3 hours. Table 5 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 6.

Catalyst Example 4

0.6 wt % Pt (IW) on 65/35 ZSM-48(90/1 $SiO_2$:$Al_2O_3$)/Theta-Alumina

Pseudobohemite alumina was calcined at 1000° C. to convert it to a lower surface area theta phase, as compared to the gamma phase alumina used as the binder in Catalyst Example 2 above. 65% of ZSM-48(90/1 $SiO_2$:$Al_2O_3$) and 35% of the calcined alumina were extruded with 0.25% PVA to 1/16" quadrulobes. The extrudate was pre-calcined in $N_2$ at 950° F., ammonium exchanged with 1N ammonium nitrate, and then dried at 250° F. followed by calcination in air at 1000° F. The extrudate was then loaded with 0.6 wt % Pt by incipient wetness impregnation with platinum tetraammine nitrate, dried at 250° F., and calcined in air at 680° F. for 3 hours. Table 5 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 6.

Catalyst Example 5

0.6 wt % Pt (IW) on 65/35 ZSM-48(90/1 $SiO_2$:$Al_2O_3$)/Zirconia

65% ZSM-48(90/1 $SiO_2$:$Al_2O_3$) and 35% Zirconia were extruded to a 1116" quadrulobe. The extrudate was pre-calcined in N2 @1000° F., ammonium exchanged with 1N ammonium nitrate, and then dried at 250° F. followed by calcination in air at 1000° F. The extrudate was then was loaded with 0.6 wt % Pt by incipient wetness impregnation with platinum tetraammine nitrate, dried at 250° F., and calcined in air at 680° F. for 3 hours. Table 5 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 6.

TABLE 5

| Catalyst Example | | BET SA ($m^2$/g) | Zeolite SA ($m^2$/g) | External SA ($m^2$/g) | Ratio Zeolite SA: External SA | BET SA ($m^2$/g) of Binder |
|---|---|---|---|---|---|---|
| 1 | 0.6% Pt on 65/35 ZSM-48 (90/1)/Titania | 200 | 95 | 104 | 91:100 | 50 |
| 2 (compar.) | 0.6% Pt on 65/35 ZSM-48 (90/1)/$Al_2O_3$ | 232 | 50 | 182 | 27:100 | 291 |
| 3 | 0.6% Pt on 80/20 ZSM-48 (90/1)/Silica | 211 | 114 | 97 | 117:100 | 79 |
| 4 | 0.6% Pt on 65/35 ZSM-48 (90/1)/Theta-Alumina | 238 | 117 | 121 | 97:100 | 39 |
| 5 | 0.6% Pt on 65/35 ZSM-48 (90/1)/Zirconia | 225 | 128 | 97 | 132:100 | 55 |
| 6 | 0.6% Pt on 50/50 ZSM-48 (90/1)/Titania | 160 | 77 | 83 | 93:100 | 50 |
| 7 | 0.6% Pt on 33/67 ZSM-48 (90/1)/Titania | 148 | 67 | 81 | 83:100 | 50 |

Table 5 shows that the catalysts from Catalyst Examples 1, 3, 4, and 5 all have a ratio of micropore surface area to BET total surface area of 25% or more.

TABLE 6

| | WHSV | Cloud Point (° C.) |
|---|---|---|
| 1 | 0.71 | −45* |
| 1 | 1.03 | −35 |
| 2 | 0.75 | −26 |
| 2 | N/A | N/A |
| 3 | 0.71 | −45* |
| 3 | 1.01 | −28 |
| 4 | 0.73 | −45* |
| 4 | 1.03 | −12 |
| 5 | 0.73 | −45* |
| 5 | 0.99 | −45* |

Note that in Table 6, a value of −45° C. represents the low end of the measurement range for the instrument used to measure the cloud point. Cloud point measurements indicated with an asterisk are believed to represent the detection limit of the instrument, rather than the actual cloud point value of the processed feed. As shown in Table 6, all of the catalysts with a ratio of micropore surface area to BET total surface area of 25% or more, produced a product with the lowest detectable cloud point at a space velocity near 0.75. By contrast, the catalyst from Catalyst Example 2, a ratio of micropore surface area to BET total surface area of less than 25%, produced a cloud point of only −26° C. for a space velocity near 0.75. Note that the alumina used to form the catalyst in Example 2 also corresponds to high surface area binder of greater than 100 $m^2$/g. At the higher space velocity of about 1.0, all of the low surface area binder catalysts also produced good results.

Catalyst Example 6

Hydrodewaxing Catalysts with High Silica to Alumina Ratios (Comparative)

Additional catalyst evaluations were carried out on comparative catalysts having a zeolite with a high silica to alumina ratio. A catalyst of 0.6 wt % Pt on 65/35 ZSM-48(180/1 $SiO_2$:$Al_2O_3$)/P25 $TiO_2$ was prepared according to the following procedure. A corresponding sample was also prepared using $Al_2O_3$ instead of $TiO_2$, which produced a catalyst of 0.6 wt % Pt on 65/35 ZSM-48 (180/1 $SiO_2$:$Al_2O_3$)/Versal-300 $Al_2O_3$.

An extrudate consisting of 65% (180/1 $SiO_2$/$Al_2O_3$) ZSM-48 and 35% Titania (50 grams) was loaded with 0.6 wt % Pt by incipient wetness impregnation with platinum tetraammine nitrate, dried at 250° F. and calcined in full air at 680° F. for 3 hours. As shown above in Table 5, the $TiO_2$ binder provides a formulated catalyst with a high ratio of zeolite surface area to external surface area. The $TiO_2$ binder also provides a lower acidity than an $Al_2O_3$ binder.

The above two catalysts were used for hydrodewaxing experiments on a multi-component model compound system designed to model a 130N raffinate. The multi-component model feed was made of 40% n-hexadecane in a decalin solvent with 0.5% dibenzothiophene (DBT) and 100 ppm N in quinoline added (bulky S, N species to monitor HDS/HDN). The feed system was designed to simulate a real waxy feed composition.

Hydrodewaxing studies were performed using a continuous catalyst testing unit composed of a liquid feed system with an ISCO syringe pump, a fixed-bed tubular reactor with a three-zone furnace, liquid product collection, and an on-line MTI GC for gas analysis. Typically, 10 cc of catalyst was sized and charged in a down-flow ⅜"stainless steel reactor containing a ⅛" thermowell. After the unit was pressure tested, the catalyst was dried at 300° C. for 2 hours with 250 cc/min $N_2$ at ambient pressure. The catalysts were then reduced by hydrogen reduction. Upon completion of the catalyst treatment, the reactor was cooled to 150° C., the unit pressure was set to 600 psig by adjusting a back-pressure regulator and the gas flow was switched from $N_2$ to $H_2$. Liquid feedstock was introduced into the reactor at 1 liquid hourly space velocity (LHSV). Once the liquid feed reached the downstream knockout pot, the reactor temperature was increased to the target value. A material balance was initiated until the unit was lined out for 6 hours. The total liquid product was collected in the material balance dropout pot and analyzed by an HP 5880 gas chromatograph (GC) with FID. The detailed aromatic component conversion and products were identified and calculated by to GC analysis. Gas samples were analyzed with an on-line HP MTI GC equipped with both TCD and FID detectors. A series of runs were performed to understand catalyst activity/product properties as function of process temperature.

All catalysts were loaded in an amount of 10 cc in the reactor and were evaluated using the operating procedure described in Catalyst Example 6 above at the following conditions: T=270-380° C., P=600 psig, liquid rate=10 cc/hr, $H_2$ circulation rate=2500 scf/B and LHSV=1 $hr^{-1}$.

Figure 4:
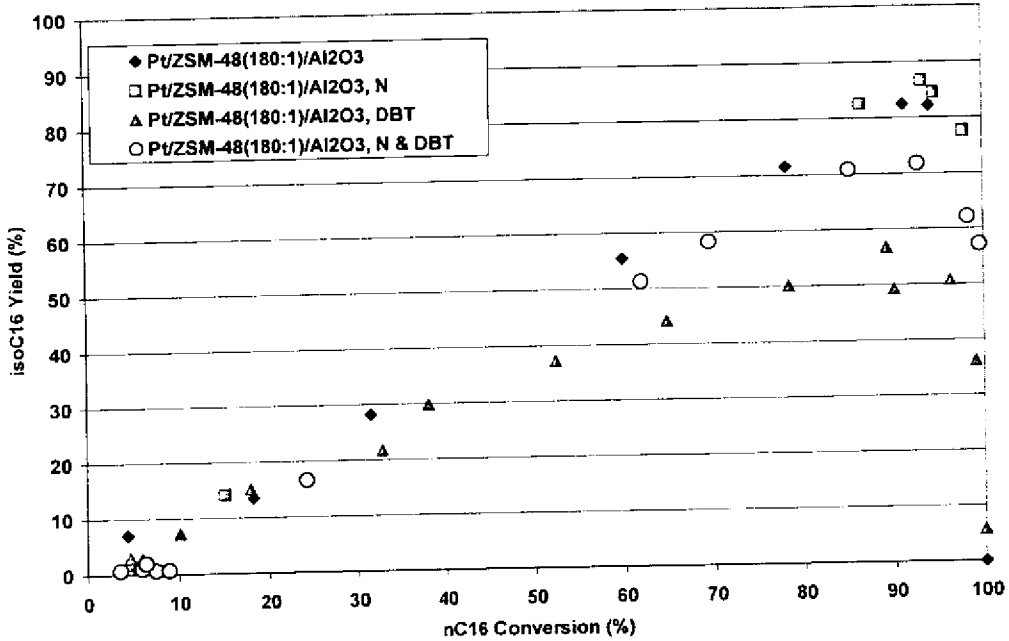
FIGS. 4 and 5 show the activity of comparative catalysts.
Figure 5:
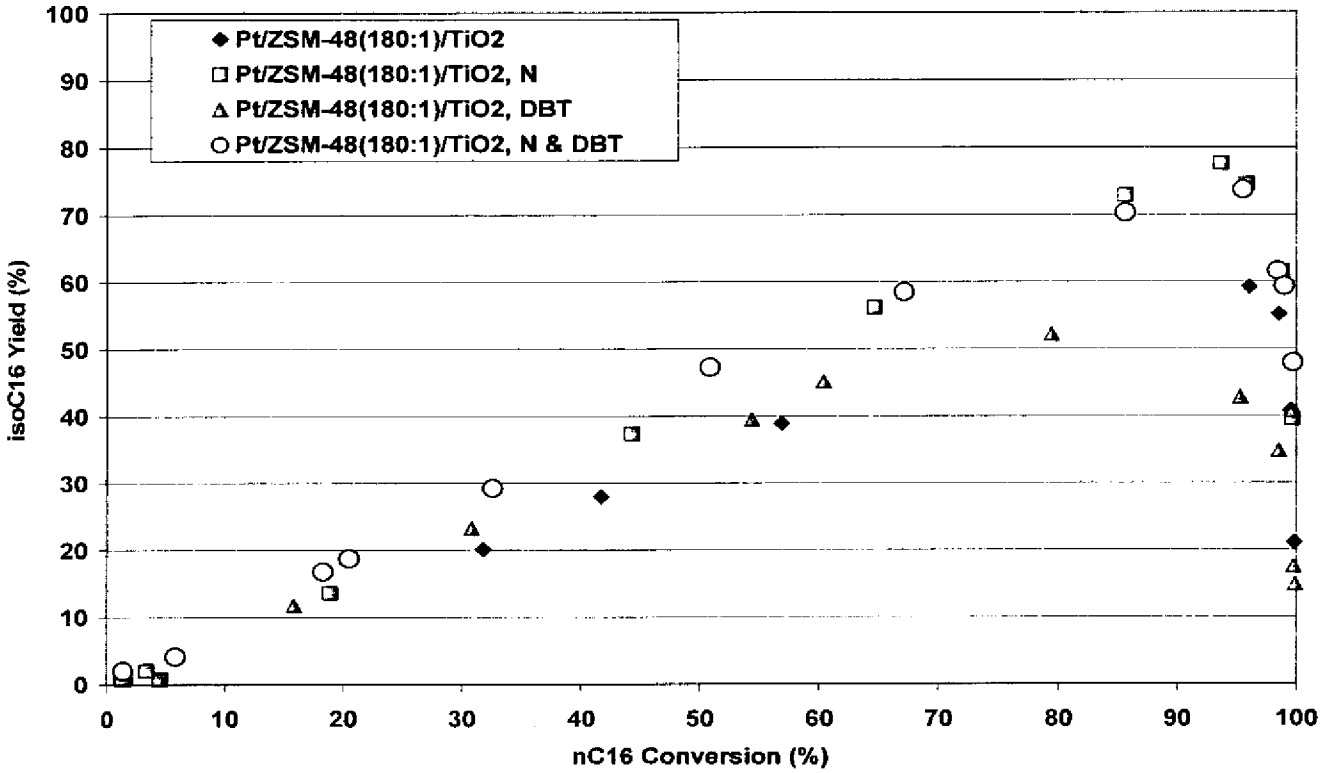

The n-hexadecane (nC16) isomerization activity and yield are summarized in FIGS. 1 and 2. FIG. 4 shows the relationship between $nC_{16}$ conversion and iso-$C_{16}$ yield for a clean feed and spiked feeds for the alumina bound (higher surface area) catalyst. FIG. 5 shows similar relationships for the titania bound (lower surface area) catalyst. In general, the catalysts with higher and lower surface area binders show similar conversion efficiency. The low surface area catalyst (FIG. 5) has slightly lower conversion efficiencies relative to yield as compared to the higher surface area catalyst. For each of these feeds, the temperatures needed to achieve a given $nC_{16}$ conversion level were similar for the two types of catalyst.

Catalyst Example 7

Hydrodewaxing Over 0.6 Wt % Pt on 65/35 ZSM-48(90/1)/$TiO_2$ Using 130N Feed This example illustrates the catalytic performance of 0.6 wt % Pt on 65/35 ZSM-48(90/1 $SiO_2/Al_2O_3$)/$TiO_2$ versus a corresponding alumina-bound (higher external surface area) catalyst using 130N raffinate.

An extrudate consisting of 65% (90/1 $SiO_2/Al_2O_3$) ZSM-48 and 35% Titania (30 grams) was loaded with 0.6 wt % Pt by incipient wetness impregnation with platinum tetraammine nitrate, dried at 250° F. and calcined in full air at 680° F. for 3 hours. A corresponding sample was also prepared using $Al_2O_3$ instead of $TiO_2$.

The catalysts were loaded in a 10 cc amount in the reactor and were evaluated using the operating procedure described in Catalyst Example 6 at the following conditions: T=330-380° C., P=400 psig, liquid rate=5 cc/hr, $H_2$ circulation rate=5000 scf/B, and LHSV=0.5 hr°. The catalysts were exposed to the 130N raffinate which contained 66 ppm nitrogen by weight and 0.63 wt % sulfur.

Figure 6:
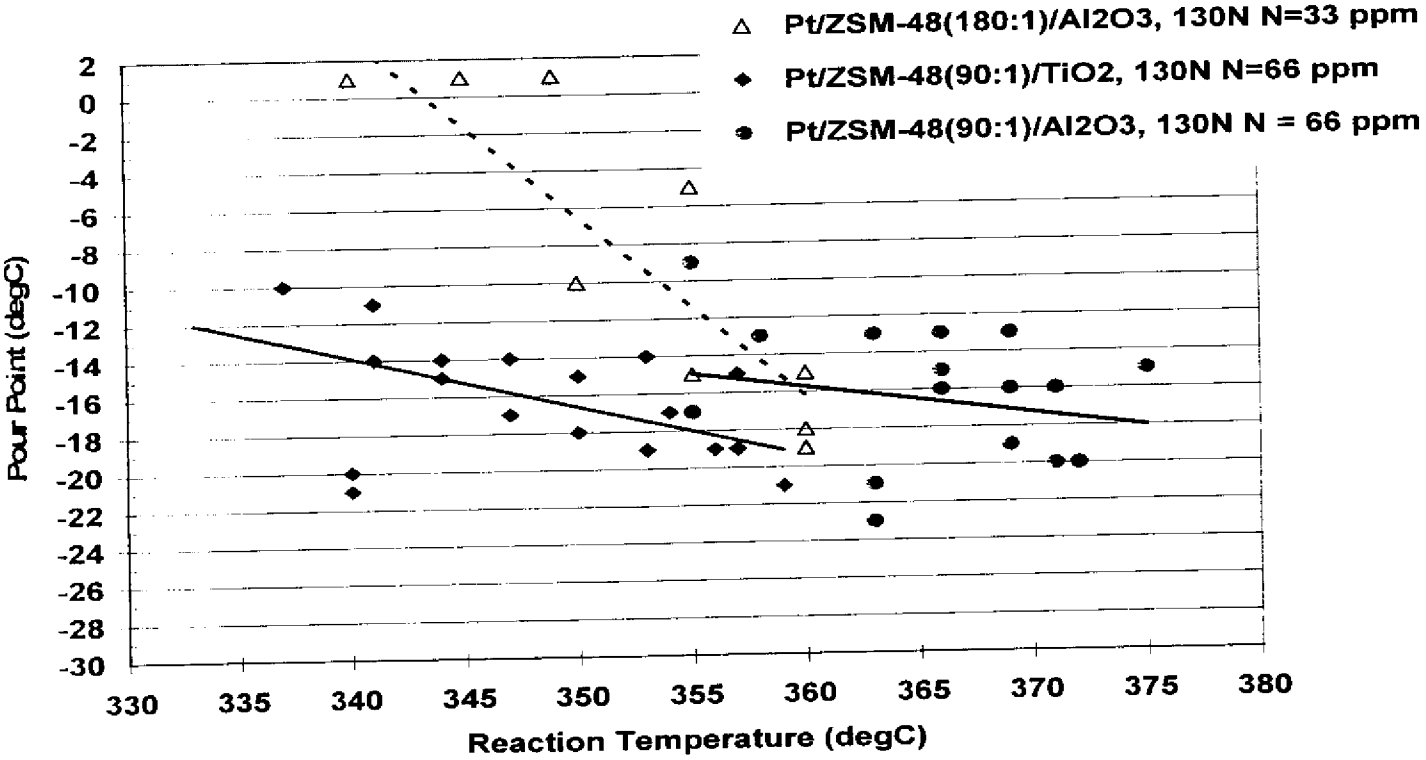
FIG. 6 shows the correlation between hydroprocessing temperature and pour point for various catalysts.
Figure 7:
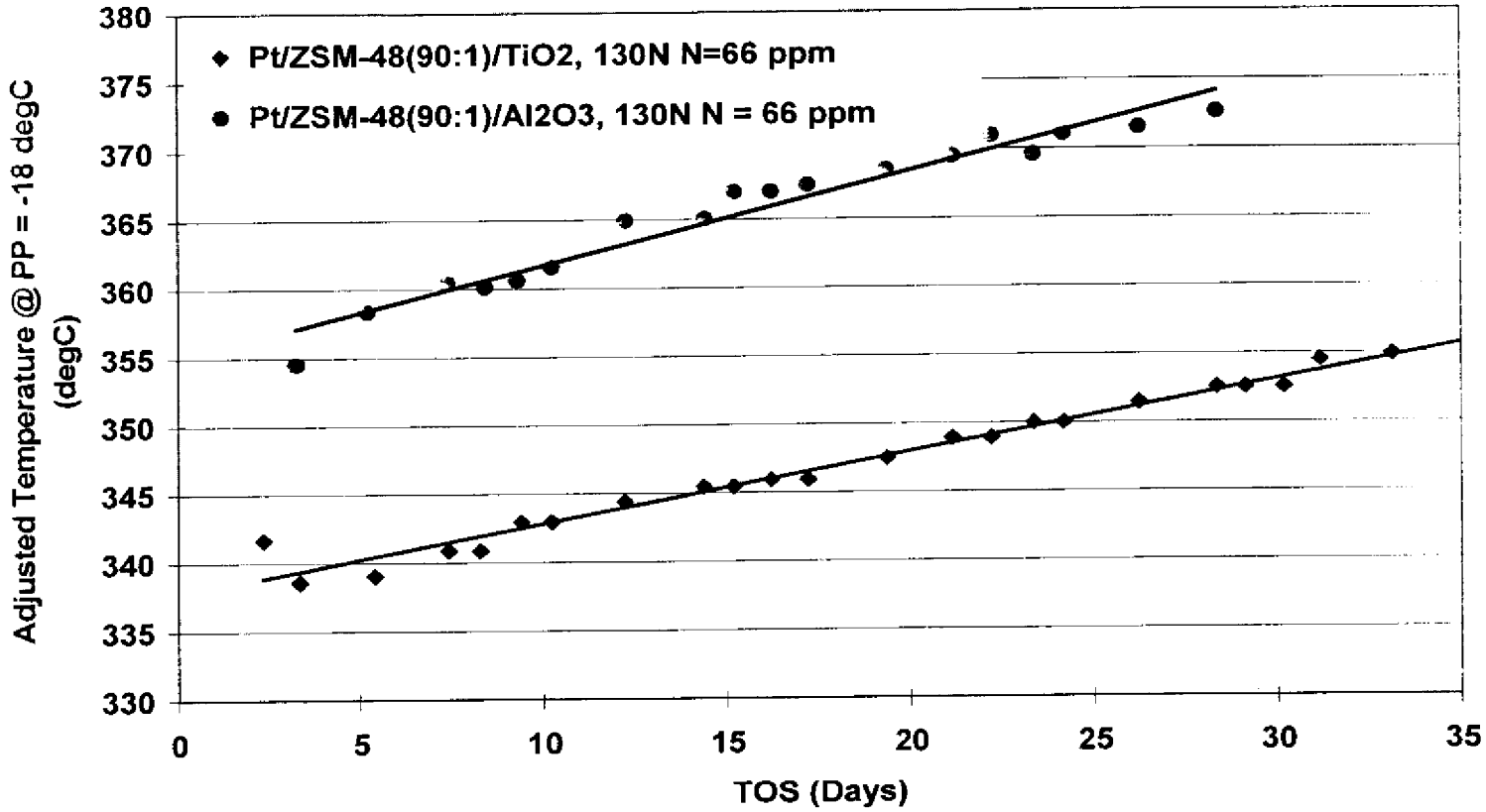
FIG. 7 shows an aging rate for various catalysts.
Figure 8:
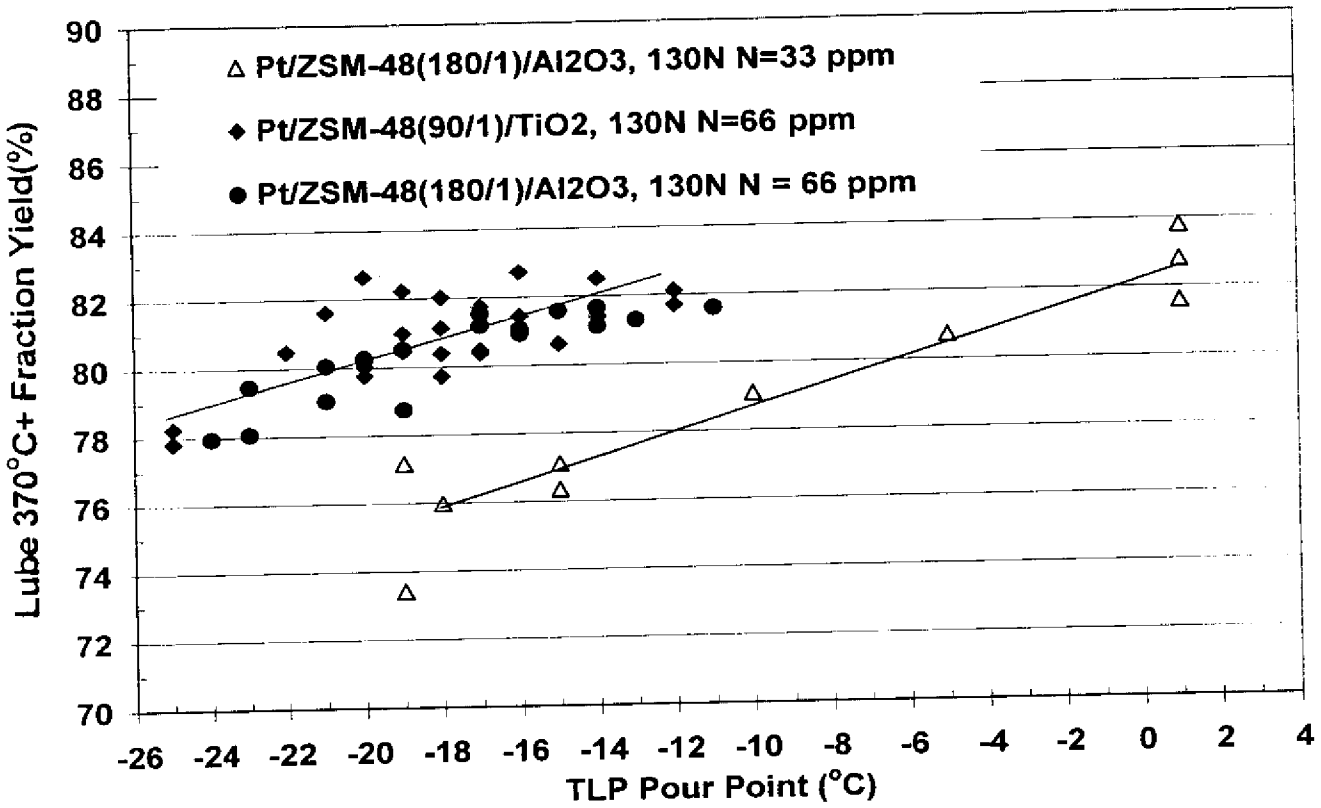
FIG. 8 shows the hydroprocessing product yield for various catalysts.
Figure 9:
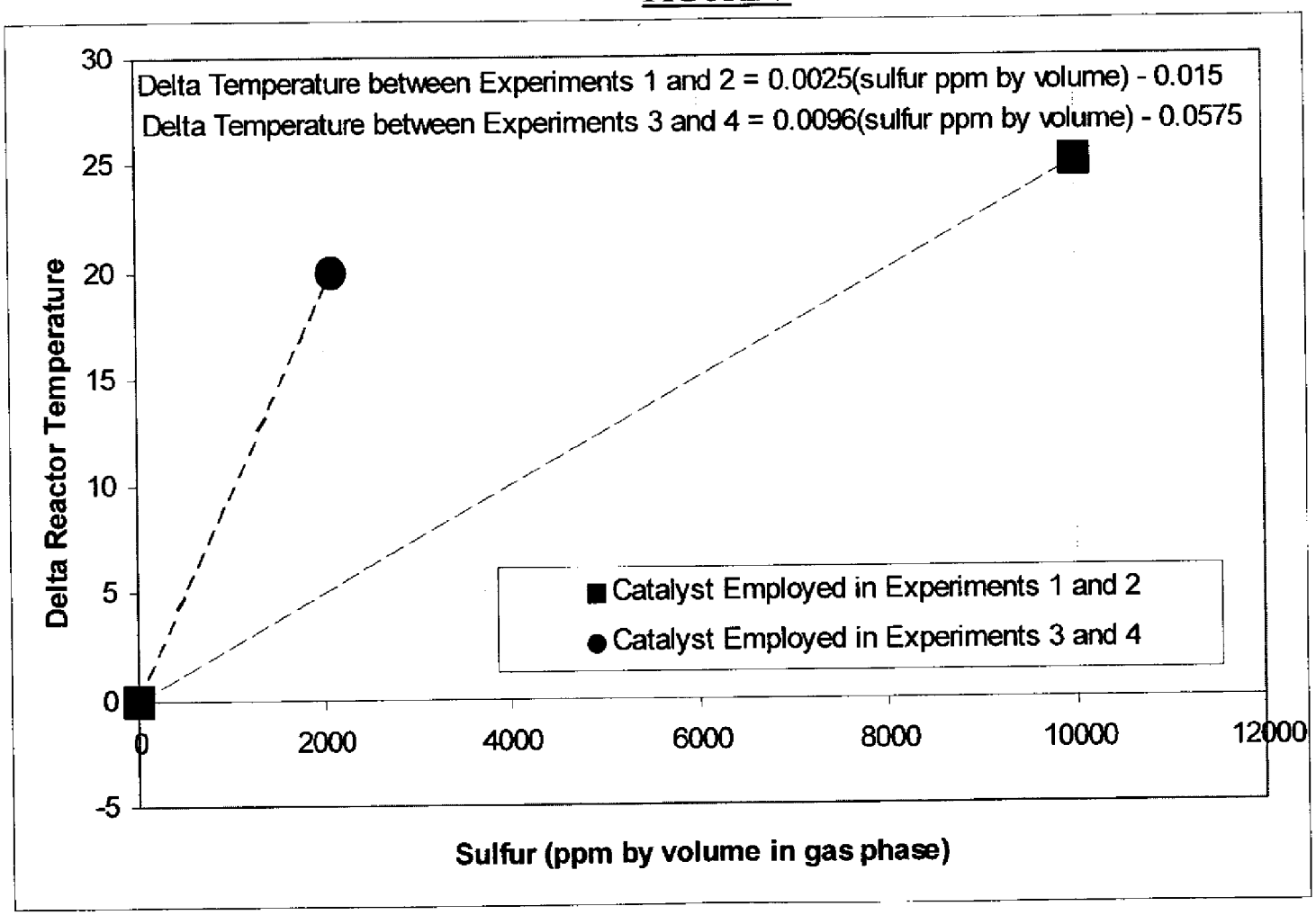
FIG. 9 shows the dewaxing reactor temperature as a function of sulfur level in the gas phase for various catalysts.

FIG. 6 shows the relative catalyst activity of the 0.6 wt % Pt on 65/35 ZSM-48(90/1 $SiO_2/Al_2O_3$)/$TiO_2$ catalyst and the corresponding alumina bound catalyst. For the 130N raffinate feed, compared with the corresponding alumina bound catalyst, the 0.6 wt % Pt on 65/35 ZSM-48(90/1 $SiO_2/Al_2O_3$)/$TiO_2$ catalyst showed a 20° C. temperature advantage (i.e. more active at 20° C. lower temp) at the given product pour point. Note that FIG. 6 also shows data for a 130N raffinate feed with half the nitrogen content that was hydroprocessed using 65/35 ZSM-48 (180/1 $SiO_2/Al_2O_3$)/$Al_2O_3$ with 0.6 wt % Pt. (This is the alumina bound catalyst from Catalyst Example 6.) Even at twice the nitrogen content, the lower surface area 65/35 ZSM-48(90/1 $SiO_2/Al_2O_3$)/$TiO_2$ with 0.6 wt % Pt catalyst achieved a substantial activity credit.

To further demonstrate the benefit of the low surface area, low silica to alumina ratio catalyst, FIG. 4 shows a TIR plot for the 0.6 wt % Pt on 65/35 ZSM-48(90/1 $SiO_2/Al_2O_3$)/$TiO_2$ catalyst and the corresponding alumina-bound catalyst. The TIR plot shows that the aging rate for the 0.6 wt % Pt on 65/35 ZSM-48 (90/1 $SiO_2/Al_2O_3$)/$TiO_2$ catalyst was 0.624° C./day compared to 0.69° C./day for the corresponding alumina-bound catalyst. Thus, when exposed to a nitrogen rich feed, the low surface area and low silica to alumina ratio catalyst provides both improved activity and longer activity lifetime.

FIG. 6 provides the lubricant yield for the 0.6 wt % Pt on 65/35 ZSM-48 (90/1 $SiO_2/Al_2O_3$)/$TiO_2$ catalyst and the two alumina bound catalysts shown in FIG. 3. The 0.6 wt % Pt on 65/35 ZSM-48(90/1 $SiO_2/Al_2O_3$)/$TiO_2$ provides the same lubricant yield as the corresponding alumina-bound (higher surface area) catalyst. The VI versus pour point relationships for the lower and higher surface area catalysts are also similar. Note that both the 0.6 wt % Pt on 65/35 ZSM-48(90/1 $SiO_2/Al_2O_3$)/$TiO_2$ catalyst and the corresponding alumina catalyst provided an improved pour point versus yield relationship as compared to the higher silica to alumina ratio catalyst.

Catalyst Example 8

Mixed Binder Systems

This example illustrates that the advantage of a low surface area binder can be realized for mixed binder systems, where a majority of the binder is a low surface area binder.

An extrudate consisting of 65% (90/1 $SiO_2/Al_2O_3$) ZSM-48 and 35% of a mixed binder was loaded with 0.6 wt % Pt by incipient wetness impregnation with platinum tetraammine nitrate, dried at 250° F. and calcined in full air at 680° F. for 3 hours. The 35 wt % binder in the extrudate was composed of 20 wt % alumina (higher surface area) and 15 wt % titania (lower surface area).

A second extrudate consisting of 65% (90/1 $SiO_2/Al_2O_3$) ZSM-48 and 35% of a mixed binder was also loaded with 0.6 wt % Pt by incipient wetness impregnation with platinum tetraammine nitrate, dried at 250° F. and calcined in full air at 680° F. for 3 hours. In the second extrudate, the 35 wt % of binder was composed of 25 wt % titania (lower surface area) and 10 wt % alumina (higher surface area).

The activity of the above catalysts was tested in a batch micro-autoclave system. For the catalyst with a binder of 20 wt % alumina and 15 wt % titania, 208.90 mg and 71.19 mg of catalyst were loaded in separate wells and reduced under hydrogen, followed by the addition of 2.5 grams of a 600N feedstock. (The 600N feedstock had similar N and S levels to the 130N feed.) The "space velocity" was 1.04 and 3.03 respectively. The reaction was run at 400 psig at 345° C. for 12 hours. The resulting cloud point of the total liquid product was −18° C. at 1.03 WHSV and 21° C. at 3.09 WHSV.

For the catalyst with a binder of 25 wt % titania and 10 wt % alumina, 212.57 mg and 69.75 mg of catalyst were loaded in separate wells and reduced under hydrogen, followed by the addition of 2.5 grams of a 600N feedstock. (The 600N feedstock had similar N and S levels to the 130N feed.) The "space velocity" was 1.02 and 3.10 respectively. The reaction was run at 400 psig at 345° C. for 12 hours. The resulting cloud point of the total liquid product was 45° C. (detection limit of cloud point instrument) at 1.03 WHSV and 3° C. at 3.09 WHSV.

The above activity tests parallel the results from Catalyst Examples 1 to 5 above. The catalyst containing a binder composed of a majority of high surface area binder behaved similarly to the catalyst with high surface area binder in Catalyst Example 2. The catalyst with a majority of low surface area binder resulted in a much more active catalyst, as seen in Catalyst Examples 1 and 3-5 above.

PCT and EP Clauses:

1. A method for producing a lube basestock, comprising: providing a process train including a first catalyst that is a hydroprocessing catalyst, and a second catalyst that is a dewaxing catalyst, wherein the dewaxing catalyst includes at least one non-dealuminated, unidimensional 10-member ring pore zeolite and at least one Group VIII metal; processing a first feedstock in the process train at first hydroprocessing conditions and first catalytic dewaxing conditions to produce a lube basestock having a pour point less than −15° C. and a total liquid product 700°+F (371° C.) yield of at least 75 wt %, the first catalytic dewaxing conditions including a temperature of 400° C. or less, the first feedstock having a first sulfur content when exposed to the dewaxing catalyst of 1000 wppm or less on a total sulfur basis; processing a second feedstock in the same process train at second hydroprocessing conditions and second catalytic dewaxing conditions, the second feedstock having a sulfur content when exposed to the dewaxing catalyst of greater than 1000 wppm on a total sulfur basis, to produce a second lube basestock having a pour point less than −15° C. and a total liquid product yield of at least 75 wt %, wherein the second catalytic dewaxing conditions include a temperature of 400° C. or less with the second catalytic dewaxing temperature being from 20 to 50° C. greater than first catalytic dewaxing temperature, and wherein the processing of the first feedstock and the processing of the second feedstock are alternated in any sequence as a function of time.

2. The method of clause 1, wherein the dewaxing catalyst includes at least one low surface area metal oxide refractory binder having a surface area of 100 $m^2/g$ or less.

3. The method of any one of the preceding clauses, further including providing a high pressure separator and/or stripper between the first hydroprocessing step and the first dewaxing step, and passing a first hydroprocessed effluent including at least a liquid effluent and $H_2S$ from the first hydroprocessing step to the high pressure separator and/or stripper to remove at least a portion of the $H_2S$ prior to the first dewaxing step.

4. The method of any one of the preceding clauses, further including providing a high pressure separator and/or stripper between the second hydroprocessing step and the second dewaxing step, and passing a second hydroprocessed effluent including at least a liquid effluent and $H_2S$ from the second hydroprocessing step to the high pressure separator and/or stripper to remove at least a portion of the $H_2S$ prior to the second dewaxing step.

5. The method of any one of the preceding clauses, wherein the first and second feedstocks are chosen from a hydrocracker bottoms, a raffinate, a wax, a previously hydroprocessed feed, and combinations thereof.

6. The method of any one of the preceding clauses, wherein the first and second hydroprocessing conditions are under effective hydroprocessing conditions chosen from hydroconversion, hydrocracking, hydrotreatment, hydrofinishing, aromatic saturation and dealkylation.

7. The method of any one of the preceding clauses further comprising hydrofinishing the first and second lube basestock under effective hydrofinishing conditions for hydrofinishing or aromatic saturation.

8. The method of any one of the preceding clauses further comprising fractionating the first and second lube basestock under effective fractionating conditions.

9. The method of any one of the preceding clauses, wherein the hydroprocessing and catalytic dewaxing steps occur in a single reactor.

10. The method of any one of the preceding clauses, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

11. The method of any one of the preceding clauses, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

12. The method of any one of the preceding clauses, wherein the dewaxing catalyst comprises a micropore surface area to total surface area of greater than or equal to 25%, wherein the total surface area equals the surface area to of any binder.

13. The method of any one of the preceding clauses, wherein the binder is chosen from silica, alumina, titania, zirconia, silica-alumina, and combinations thereof.

14. The method of any one of the preceding clauses, wherein the dewaxing catalyst comprises from 0.1 wt % to 5 wt % of the at least one Group VIII metal.

15. The method of any one of the preceding clauses, wherein the at least one Group VIII metal is platinum.

16. A method for producing a lube basestock, comprising: providing a feedstock including sulfur in the range from 0.005 wt % to 5 wt %, a process train including a first catalyst that is a hydroprocessing catalyst, and a second catalyst that is a dewaxing catalyst, a real-time hydroprocessed effluent sulfur monitor, and a process controller for controlling the temperature of the second catalyst as a function of the sulfur level in the hydroprocessed effluent, wherein the dewaxing catalyst includes at least one non-dealuminated, unidimensional 10-member ring pore zeolite and at least one Group VIII metal; monitoring the sulfur level of the hydroprocessed effluent using the sulfur monitor followed by controlling the dewaxing catalyst temperature as a function of the sulfur level of the hydroprocessed effluent using the process controller; processing the feedstock in the process train at effective hydroprocessing conditions and effective catalytic dewaxing conditions sufficient to produce a lube basestock having a pour point less than −15° C. and a total liquid product 700°+F (371° C.) yield of at least 75 wt %; and wherein the process controller increases the temperature of the dewaxing catalyst with increasing sulfur level in the hydroprocessed effluent up to a maximum of 400° C.

17. The method of clause 16, wherein the dewaxing catalyst includes at least one low surface area metal oxide refractory binder having a surface area of 100 $m^2/g$ or less.

18. The method of clauses 16 or 17, further including providing a high pressure separator and/or stripper between the hydroprocessing step and the dewaxing step, and passing the hydroprocessed effluent including at least a liquid effluent and $H_2S$ from the hydroprocessing step to the high pressure separator and/or stripper to remove at least a portion of the $H_2S$ prior to the dewaxing step.

19. The method of any one of clause 16-18, wherein the feedstock is chosen from a hydrocracker bottoms, a raffinate, a wax, a previously hydroprocessed feed, and combinations thereof.

20. The method of any one of clauses 16-19, wherein the hydroprocessing conditions are under effective hydroprocessing conditions chosen from hydroconversion, hydrocracking, hydrotreatment, hydrofinishing, aromatic saturation and dealkylation.

21. The method of any one of clauses 16-20 further comprising hydrofinishing the lube basestock under effective hydrofinishing conditions for hydrofinishing or aromatic saturation.

22. The method of any one of clauses 16-21 further comprising fractionating the lube basestock under effective fractionating conditions.

23. The method of any one of clauses 16-22, wherein the hydroprocessing and catalytic dewaxing steps occur in a single reactor.

24. The method of any one of clauses 16-23, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

25. The method of any one of clauses 16-24, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

26. The method of any one of clauses 16-25, wherein the dewaxing catalyst comprises a micropore surface area to total surface area of greater than or equal to 25%, where the total surface area equals the surface area of the external zeolite plus the surface area of any binder.

27. The method of any one of clauses 16-26, wherein the binder is chosen from silica, alumina, titania, zirconia, silica-alumina, and combinations thereof.

28. The method of any one of clauses 16-27, wherein the dewaxing catalyst comprises from 0.1 wt % to 5 wt % of the at least one Group VIII metal.

29. The method of any one of clauses 16-28, wherein the at least one Group VIII metal is platinum.

30. The method of any one of clauses 16-29, wherein the process controller controls the temperature of the dewaxing catalyst over a range of 1 to 50° C. as a function of sulfur level in the hydroprocessed effluent.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While to the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains. The disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for producing a lube basestock, comprising:

providing a process train including a first catalyst that is a hydroprocessing catalyst, and a second catalyst that is a dewaxing catalyst, wherein the dewaxing catalyst includes at least one non-dealuminated, unidimensional 10-member ring pore zeolite and at least one Group VIII metal;

processing a first feedstock in the process train at first hydroprocessing conditions and first catalytic dewaxing conditions to produce a lube basestock having a pour point less than −15° C. and a total liquid product 700° +F. (371° C.) yield of at least 75 wt %, the first catalytic dewaxing conditions including a temperature of 400° C. or less, the first feedstock having a first sulfur content when exposed to the dewaxing catalyst of 1000 wppm or less on a total sulfur basis;

processing a second feedstock in the same process train at second hydroprocessing conditions and second catalytic dewaxing conditions, the second feedstock having a sulfur content when exposed to the dewaxing catalyst of greater than 1000 wppm on a total sulfur basis, to produce a second lube basestock having a pour point less than −15° C. and a total liquid product yield of at least 75 wt %, wherein the second catalytic dewaxing conditions include a temperature of 400° C. or less with the second catalytic dewaxing temperature being from 20 to 50° C. greater than the first catalytic dewaxing temperature, wherein the dewaxing catalyst comprises includes at least one low surface area metal oxide refractory binder having a surface area of 100 $m^2/g$ or less, the dewaxing catalyst further comprising a micropore surface area to total surface area of greater than or equal to 25%, the micropore surface area being the surface area from the pores of the zeolite, the total surface area being equal to the surface area of the external zeolite plus the surface area of a binder, and wherein the processing of the first feedstock and the processing of the second feedstock are alternated in any sequence as a function of time.

2. The method of claim 1, further including providing a high pressure separator and/or stripper between the first hydroprocessing step and the first dewaxing step, and passing a first hydroprocessed effluent including at least a liquid effluent and $H_2S$ from the first hydroprocessing step to the high pressure separator and/or stripper to remove at least a portion of the $H_2S$ prior to the first dewaxing step.

3. The method of claim 1, further including providing a high pressure separator and/or stripper between the second hydroprocessing step and the second dewaxing step, and passing a second hydroprocessed effluent including at least a liquid effluent and $H_2S$ from the second hydroprocessing step to the high pressure separator and/or stripper to remove at least a portion of the $H_2S$ prior to the second dewaxing step.

4. The method of claim 1, wherein the first and second feedstocks are chosen from a hydrocracker bottoms, a raffinate, a wax, a previously hydroprocessed feed, and combinations thereof.

5. The method of claim 1, wherein the first and second hydroprocessing conditions are under effective hydroprocessing conditions chosen from hydroconversion, hydrocracking, hydrotreatment, hydrofinishing, aromatic saturation and dealkylation.

6. The method of claim 1 further comprising hydrofinishing the first and second lube basestock under effective hydrofinishing conditions for hydrofinishing or aromatic saturation.

7. The method of claim 1 or 6 further comprising fractionating the first and second lube basestock under effective fractionating conditions.

8. The method of claim 7 further comprising hydrofinishing the fractionated first and second lube basestock under effective hydrofinishing conditions for hydrofinishing or aromatic saturation.

9. The method of claim 1, wherein the hydroprocessing and catalytic dewaxing steps occur in a single reactor.

10. The method of claim 1, wherein the dewaxing catalyst comprises a molecular sieve with a $SiO_2$:$Al_2O_3$ ratio of from about 200:1 to 30:1 and comprises from 0.1 wt % to 2.7 wt % framework $Al_2O_3$ content.

11. The method of claim 10, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

12. The method of claim 10, wherein the molecular sieve is EU-2, EU-11, ZBM-30, ZSM-48, ZSM-23, or a combination thereof.

13. The method of claim 10, wherein the molecular sieve is ZSM-48.

14. The method of claim 1, wherein the dewaxing catalyst includes at least one low surface area metal oxide refractory binder having a surface area of 50 $m^2/g$ or less.

15. The method of claim 1, wherein the binder is chosen from silica, alumina, titania, zirconia, silica-alumina, and combinations thereof.

16. The method of claim 1, wherein the dewaxing catalyst comprises from 0.1 wt % to 5 wt % of the at least one Group VIII metal.

17. The method of claim 1, wherein the at least one Group VIII metal is platinum.

18. A method for producing a lube basestock, comprising:

providing a feedstock including sulfur in the range from 0.005 wt % to 5 wt %, a process train including a first catalyst that is a hydroprocessing catalyst, and a second catalyst that is a dewaxing catalyst, a real-time hydroprocessed effluent sulfur monitor, and a process controller for controlling the temperature of the second catalyst as a function of the sulfur level in the hydroprocessed effluent, wherein the dewaxing catalyst includes at least one non-dealuminated, unidimensional 10-member ring pore zeolite and at least one Group VIII metal;

monitoring the sulfur level of the hydroprocessed effluent using the sulfur monitor followed by controlling the dewaxing catalyst temperature as a function of the sulfur level of the hydroprocessed effluent using the process controller;

processing the feedstock in the process train at effective hydroprocessing conditions and effective catalytic dewaxing conditions sufficient to produce a lube basestock having a pour point less than −15° C. and a total liquid product 700° +F. (371° C.) yield of at least 75 wt %, wherein the dewaxing catalyst comprises includes at least one low surface area metal oxide refractory binder having a surface area of 100 $m^2/g$ or less, the dewaxing catalyst further comprising a micropore surface area to total surface area of greater than or equal to 25%, the micropore surface area being the surface area from the pores of the zeolite, the total surface area being equal to the surface area of the external zeolite plus the surface area of a binder, and wherein the process controller increases the temperature of the dewaxing catalyst with increasing sulfur level in the hydroprocessed effluent up to a maximum of 400° C., the increase in temperature being at least about 20° C. during the processing of the feedstock in the process train.

19. The method of claim 18, further including providing a high pressure separator and/or stripper between the hydroprocessing step and the dewaxing step, and passing the hydroprocessed effluent including at least a liquid effluent and $H_2S$ from the hydroprocessing step to the high pressure separator and/or stripper to remove at least a portion of the $H_2S$ prior to the dewaxing step.

20. The method of claim 18, wherein the feedstock is chosen from a hydrocracker bottoms, a raffinate, a wax, a previously hydroprocessed feed, and combinations thereof.

21. The method of claim 18, wherein the hydroprocessing conditions are under effective hydroprocessing conditions chosen from hydroconversion, hydrocracking, hydrotreatment, hydrofinishing, aromatic saturation and dealkylation.

22. The method of claim 18 further comprising hydrofinishing the lube basestock under effective hydrofinishing conditions for hydrofinishing or aromatic saturation.

23. The method of claim 18 or 22 further comprising fractionating the lube basestock under effective fractionating conditions.

24. The method of claim 23 further comprising hydrofinishing the fractionated lube basestock under effective hydrofinishing conditions for hydrofinishing or aromatic saturation.

25. The method of claim 18, wherein the hydroprocessing and catalytic dewaxing steps occur in a single reactor.

26. The method of claim 18, wherein the dewaxing catalyst comprises a molecular sieve with a $SiO_2$:$Al_2O_3$ ratio of from about 200:1 to 30:1 and comprises from 0.1 wt % to 2.7 wt % framework $Al_2O_3$ content.

27. The method of claim 26, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

28. The method of claim 26, wherein the molecular sieve is EU-2, EU-11, ZBM-30, ZSM-48, ZSM-23, or a combination thereof.

29. The method of claim 26, wherein the molecular sieve is ZSM-48.

30. The method of claim 18, wherein the dewaxing catalyst includes at least one low surface area metal oxide refractory binder having a surface area of 50 $m^2/g$ or less.

31. The method of claim 18, wherein the binder is chosen from silica, alumina, titania, zirconia, silica-alumina, and combinations thereof.

32. The method of claim 18, wherein the dewaxing catalyst comprises from 0.1 wt % to 5 wt % of the at least one Group VIII metal.

33. The method of claim 18, wherein the at least one Group VIII metal is platinum.

34. The method of claim 18, wherein the process controller controls the temperature of the dewaxing catalyst over a range of 1 to 50° C. as a function of sulfur level in the hydroprocessed effluent.

* * * * *